US011596207B2

(12) United States Patent
Lapierre et al.

(10) Patent No.: US 11,596,207 B2
(45) Date of Patent: Mar. 7, 2023

(54) METHOD OF CUSTOMIZING A BOOT

(71) Applicant: SPORT MASKA INC., Montreal (CA)

(72) Inventors: Philippe Lapierre, Montréal (CA); Andrew Cormack, Deux-Montagnes (CA)

(73) Assignee: SPORT MASKA INC., Montreal (CA)

( * ) Notice: Subject to any disclaimer, the term of this patent is extended or adjusted under 35 U.S.C. 154(b) by 143 days.

(21) Appl. No.: 16/920,468

(22) Filed: Jul. 3, 2020

(65) Prior Publication Data

US 2021/0000221 A1 Jan. 7, 2021

Related U.S. Application Data

(60) Provisional application No. 62/870,503, filed on Jul. 3, 2019.

(51) Int. Cl.

| | |
|---|---|
| ***A43D 11/12*** | (2006.01) |
| ***A43D 5/04*** | (2006.01) |
| ***A43B 5/16*** | (2006.01) |
| ***A43D 1/02*** | (2006.01) |
| ***A43D 3/02*** | (2006.01) |
| ***A43D 25/07*** | (2006.01) |
| ***A63C 1/42*** | (2006.01) |
| ***A43B 5/04*** | (2006.01) |

(52) U.S. Cl.

CPC ..... *A43D 11/12* (2013.01); *A43B 5/0427* (2013.01); *A43B 5/16* (2013.01); *A43D 1/025* (2013.01); *A43D 3/027* (2013.01); *A43D 25/07* (2013.01); *A63C 1/42* (2013.01); *A43D 2200/60* (2013.01)

(58) Field of Classification Search

CPC ..... A43D 11/12; A43D 11/006; A43D 86/00; A43D 95/10; A43D 2200/60; A43D 1/025; A43D 1/02; A43D 1/04; A43D 3/027; A43D 3/10; A43D 3/12; A43D 3/1416; A43D 999/00; A43D 3/1441; B29D 35/128; B29D 35/12; B29D 35/146; B29D 35/148

See application file for complete search history.

(56) References Cited

U.S. PATENT DOCUMENTS

| | | | | |
|---|---|---|---|---|
| 8,549,688 | B2 * | 10/2013 | Leitner | A43D 3/08 12/114.2 |
| 9,221,211 | B2 * | 12/2015 | Klein | B29C 51/10 |
| 2018/0317610 | A1 * | 11/2018 | Golub | B33Y 10/00 |

* cited by examiner

*Primary Examiner* — Khoa D Huynh
*Assistant Examiner* — Erick I Lopez
(74) *Attorney, Agent, or Firm* — Norton Rose Fulbright Canada

(57) ABSTRACT

A method of customizing a boot, for example a skate boot, includes generating a tridimensional digital representation of a wearer's foot using numerical data obtained by scanning the wearer's foot. A boot with a foot size corresponding generally to a foot length of the wearer's foot is selected. A core is also selected. The core, a medial side insert and a lateral side insert are inserted into an internal space of the boot such that the medial side insert and the lateral side insert straddle the core. The medial side insert and the lateral side insert are manufactured based on the tridimensional shape of the foot. At least a portion of the boot is then heated such that the boot is thermoformed to follow surfaces of the medial and lateral side inserts. The core, the medial side insert and the lateral side insert are then removed from the boot.

20 Claims, 23 Drawing Sheets

FIG. 1
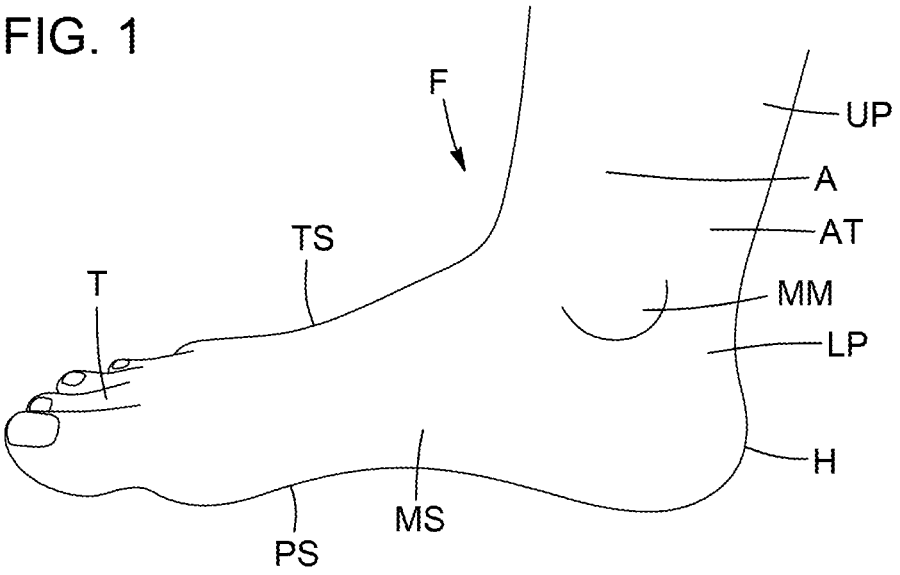
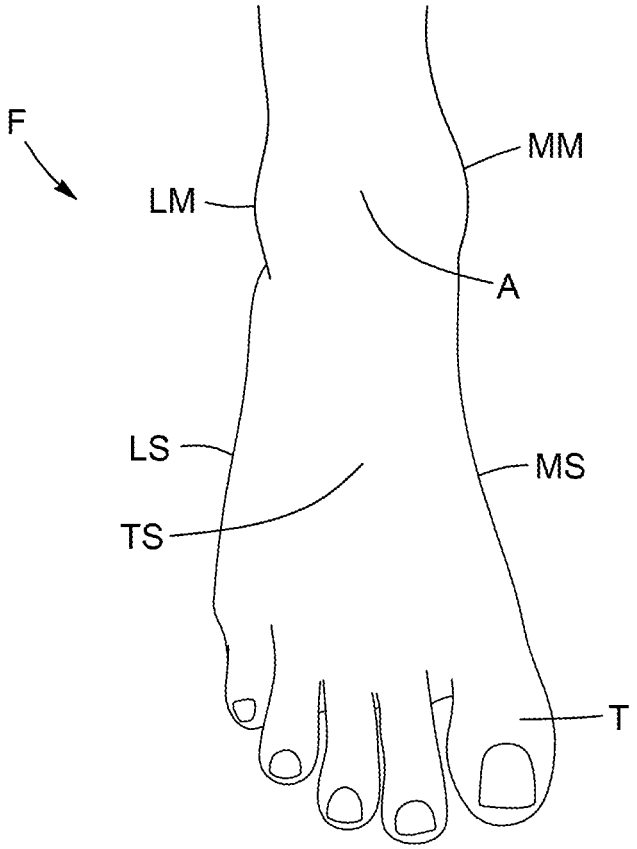
FIG. 2

METHOD OF CUSTOMIZING A BOOT

CROSS-REFERENCE TO RELATED APPLICATIONS

This application claims priority from U.S. Patent Application No. 62/870,503 filed on Jul. 3, 2019, the entire contents of which are incorporated herein.

TECHNICAL FIELD

The present disclosure relates generally to sports boots, such as skate boots, and more particularly to systems, methods and kits for customizing a boot such that the internal cavity of the boot complies with the foot of a wearer.

BACKGROUND

Footwear such as shoes or boots that are used for sports or other activities typically fall within general size ranges based on the foot size of a wearer. To further enhance comfort, fit and/or performance, the sizing of such footwear may be customized based on the specific measurements of an individual wearer's foot.

While known boot customization methods may allow for the customization of a shoe or boot according to the shape of the wearer's foot, there remains a need in the industry for a method of customizing a boot that further reduces both the manufacturing cost and complexity of the components or method, simplifies the design of the components used in the method and/or provides a better way to customize the fit of the boot by thermoforming the boot according to the wearer's foot in a wearing condition.

SUMMARY

As embodied and broadly described herein, according to an aspect, there is therefore provided a method of customizing a boot, comprising: generating a tridimensional digital representation of a wearer's foot using numerical data corresponding to a tridimensional shape of the wearer's foot obtained by scanning the wearer's foot, and processing the numerical data to obtain the tridimensional digital representation of the wearer's foot; selecting the boot with a foot size corresponding generally to a foot length of the wearer's foot, the boot being at least partially made of a thermoformable material, the boot including an inner surface defining an internal space for receiving the wearer's foot; selecting a core having a foot size generally corresponding to the foot size of the boot; inserting the core, a medial side insert having a medial external surface and a lateral side insert having a lateral external surface into the internal space of the boot such that the medial side insert and the lateral side insert straddle the core, and the medial external surface and the lateral external surface are adjacent the inner surface of the boot, wherein the medial side insert and the lateral side insert are manufactured based on the tridimensional shape of the foot; heating at least a portion of the boot such that the inner surface of the boot is thermoformed to follow the medial external surface and the lateral external surface, the thermoforming defining medial and lateral tridimensional shapes in the inner surface of the boot conforming to the tridimensional shape of the foot; and removing the core, the medial side insert and the lateral side insert from the boot.

The method of customizing a boot as defined above and herein may also include, in whole or in part, and in any combination, one or more of the following additional steps and/or features.

Customizing the boot further includes inserting a rear insert having a rear external surface into the internal space of the boot adjacent a rear surface of the core such that the rear external surface is adjacent a rear internal surface of the boot, wherein the rear insert is manufactured based on a rear portion of the tridimensional shape of the foot and the rear internal surface of the boot is thermoformable to conform to the rear external surface of the rear insert.

The rear insert is inserted into the internal space of the boot before or after inserting the medial side insert and the lateral side insert into the internal space of the boot.

The medial side insert, the lateral side insert and the rear insert are inserted into the internal space of the boot before inserting the core into the internal space of the boot.

Customizing the boot further includes pre-heating the boot to pre-soften the thermoformable material before inserting the medial side insert, the lateral side insert and the rear insert into the internal space of the boot.

Pre-heating the boot includes placing the boot in an oven at a temperature of about 200° F. to about 300° F. for about 2 minutes to about 5 minutes.

Heating the boot includes placing the boot in an oven at a temperature of about 200° F. to about 300° F. for about 2 minutes to about 4 minutes.

Heating the boot further includes placing the boot on a platform and enclosing the boot in a flexible envelope such that the boot is covered by the envelope and an air-tight seal is obtained between the envelope and the platform, creating a vacuum in the envelope for applying pressure to the boot.

The wearer's foot is scanned in a store and the boot is heated in the store.

Heating the boot further includes applying a pressure of about 5 psi to about 15 psi for about 5 minutes to about 10 minutes to the boot.

Customizing the boot further includes pre-identifying regions of the wearer's foot requiring customization.

Scanning the wearer's foot further includes scanning only the pre-identified regions of the wearer's foot requiring customization.

As embodied and broadly described herein, according to another aspect, there is also provided a method of manufacturing customized inserts for a boot that is at least partially thermoformable, the method comprising: receiving numerical data corresponding to a scanned tridimensional shape of a wearer's foot for use with the boot; manufacturing a medial side insert based on the tridimensional shape of the wearer's foot, the medial side insert having a medial internal surface and a medial external surface conforming to a medial side shape of the wearer's foot; and manufacturing a lateral side insert based on the tridimensional shape of the wearer's foot, the lateral side insert having a lateral internal surface and a lateral external surface conforming to a lateral side shape of the wearer's foot; wherein the medial side insert and the lateral side insert are shaped to be insertable into the boot with an insertable core dimensioned to generally correspond to a foot size of the boot, the medial internal surface and the lateral internal surface abutting outer surfaces of the core.

The method of manufacturing customized inserts as defined above and herein may also include, in whole or in part, and in any combination, one or more of the following additional steps and/or features.

Manufacturing the medial side insert is done by one of a subtractive manufacturing process or an additive manufacturing process.

Manufacturing the lateral side insert is done by one of a subtractive manufacturing process or an additive manufacturing process.

Manufacturing a rear insert based on the tridimensional shape of the wearer's foot, the rear insert having a rear internal surface and a rear external surface conforming to a rear shape of the wearer's foot.

The rear insert is shaped to be insertable along with the medial side insert, the lateral side insert and the core into the boot, the rear internal surface abutting a rear surface of the core.

Manufacturing the rear insert further includes manufacturing the rear internal surface to be substantially flat.

Manufacturing the rear insert is done by one of a subtractive manufacturing process or an additive manufacturing process.

Manufacturing the medial side insert further includes manufacturing the medial internal surface to be substantially flat.

Manufacturing the lateral side insert further includes manufacturing the lateral internal surface to be substantially flat.

Manufacturing the medial side insert further includes manufacturing the medial side insert from a polyurethane foam.

Manufacturing the lateral side insert further includes manufacturing the lateral side insert from a polyurethane foam.

Manufacturing the rear insert further includes manufacturing the rear insert from a polyurethane foam.

As embodied and broadly described herein, according to a further aspect, there is also provided a kit for customizing a thermoformable boot, comprising: a re-usable core dimensioned to generally correspond to a foot size of the thermoformable boot, the re-usable core selected from a group of re-usable cores each corresponding to a different range of standardized foot sizes; a sacrificial medial side insert manufactured based on a tridimensional shape of a wearer's foot, the sacrificial medial side insert having a medial internal surface and a medial external surface generally conforming to a medial side shape of the wearer's foot; and a sacrificial lateral side insert manufactured based on the tridimensional shape of the wearer's foot, the sacrificial lateral side insert having a lateral internal surface and a lateral external surface generally conforming to a lateral side shape of the wearer's foot; wherein the sacrificial medial side insert and the sacrificial lateral side insert are insertable into the boot with the selected re-usable core having a foot size generally corresponding to a foot size of the boot, the medial internal surface and the lateral internal surface abutting outer surfaces of the re-usable core.

The kit for customizing a thermoformable boot as defined above and herein may also include, in whole or in part, and in any combination, one or more of the following additional steps and/or features.

A sacrificial rear insert manufactured based on the tridimensional shape of the wearer's foot, the sacrificial rear insert having a rear internal surface and a rear external surface generally conforming to a rear shape of the wearer's foot, the sacrificial rear insert insertable along with the sacrificial medial side insert, the sacrificial lateral side insert and the selected re-usable core into the boot, the rear internal surface abutting a rear surface of the selected re-usable core.

The selected re-usable core is positionable in the boot between the sacrificial medial side insert and the sacrificial lateral side insert and in front of the sacrificial rear insert.

The outer surfaces and the rear surface of the selected re-usable core are substantially flat, wherein the medial internal surface of the sacrificial medial side insert is substantially flat, wherein the lateral internal surface of the sacrificial lateral side insert is substantially flat, and wherein the rear internal surface of the sacrificial rear insert is substantially flat.

The sacrificial medial side insert and the sacrificial lateral side insert are each manufactured from polyurethane foam.

The sacrificial rear insert is manufactured from polyurethane foam.

There is further provided, in accordance with another aspect, a method of customizing a skate boot that includes generating a tridimensional digital representation of a wearer's foot using numerical data obtained by scanning the wearer's foot, selecting a boot with a foot size corresponding generally to a foot length of the wearer's foot, and selecting a core corresponding to the selected boot. Inserting a core, a medial side insert and a lateral side insert into an internal space of the boot, such that the medial side insert and the lateral side insert straddle the core. The medial side insert and the lateral side insert are manufactured based on the tridimensional shape of the foot, such that they are wearer-specific. At least a portion of the boot is then heated such that the boot is thermoformed to follow one or more external surfaces of the medial and lateral side inserts. The core, the medial side insert and the lateral side insert are then removed from the boot.

According to a further broad aspect, there is provided a method of customizing a boot, comprising: (a) measuring a wearer's foot having a tridimensional shape for obtaining numerical data of the tridimensional shape of the wearer's foot; (b) processing the numerical data for obtaining a scanned tridimensional shape of the wearer's foot; (c) transforming the scanned tridimensional shape of the wearer's foot into a tridimensional shape of the foot in a wearing condition; (d) using the tridimensional shape of the foot in the wearing condition for manufacturing medial and lateral side inserts comprising medial and lateral external surfaces wherein the medial and lateral external surfaces define medial and lateral tridimensional shapes; (e) providing the medial and lateral inserts; (f) selecting the boot with a foot size corresponding to a foot length of the wearer's foot, the boot being at least partially made of a thermoformable material, the boot comprising an inner surface defining an internal space for receiving the wearer's foot; (g) selecting a core having a foot size corresponding to the foot size of the boot; (h) inserting the medial and lateral side inserts and the core in the internal space of the boot such that the core is located between the medial and lateral side inserts and such that the medial and lateral external surfaces of the medial and lateral side inserts contact the inner surface of the boot; (i) thermoforming the boot such that the inner surface of the boot is thermoformed to follow the medial and lateral external surfaces of the medial and lateral inserts and to define medial and lateral tridimensional shapes complying with medial and lateral shapes of the foot in the wearing condition; and (j) removing the core and the medial and lateral inserts from the boot.

In an embodiment, the tridimensional shape of the foot in the wearing condition is used for manufacturing a rear insert comprising a rear external surface wherein the rear external surface defines a rear tridimensional shape.

In an embodiment, the rear insert is inserted in the internal space of the boot before or after insertion of the medial and lateral side inserts in the internal space of the boot such that the rear external surface of the rear insert contacts the rear internal surface of the boot when the core is located between the medial and lateral side inserts and such that the rear internal surface of the boot is thermoformed to follow the rear external surface of the rear insert and to define a rear tridimensional shape complying with a rear shape of the foot in the wearing condition.

In an embodiment, the inserting step comprises inserting the medial and lateral side inserts and the rear insert before inserting the core in the internal space of the boot.

In an embodiment, before the inserting step, the boot is placed in an oven for pre-softening the thermoformable material, and after the inserting step, the boot is placed in the oven for softening the thermoformable material.

In an embodiment, the pre-softening step comprises placing the boot in an oven at a temperature of about 200° F. to about 300° F. for about 2 minutes to about 5 minutes and the softening step comprises placing the boot in the oven at a temperature of about 200° F. to about 300° F. for about 2 minutes to about 4 minutes.

In an embodiment, in the thermoforming step, the boot is placed on a platform and enclosed in a flexible envelop such that the boot is covered by the envelope and an air-tight seal is obtained between the envelope and the platform and a vacuum is created in the envelope for applying pressure to the boot.

In an embodiment, the core comprises first and second flat surfaces, wherein the medial side inserts has a medial flat inner surface opposed to the medial external surface, wherein the lateral side inserts has a lateral flat inner surface opposed to the lateral external surface, and wherein, when the core is located between the medial and lateral side inserts, the first flat surface of the core contacts and follows the medial flat inner surface of the medial side insert and the second flat surface of the core contacts and follows the lateral flat inner surface of the lateral side insert.

In an embodiment, the measuring step is in a store, the manufacturing step of the medial and lateral side inserts is in a factory and the applying pressure step is in a store.

In an embodiment, each of the medial and lateral side inserts is made by subtractive manufacturing process wherein layers of material are removed from a blank to obtain the tridimensional shape of the external surface of the insert.

In an embodiment, each of the medial and lateral side inserts is made by an additive manufacturing process to obtain the tridimensional shape of the external surface of the insert.

In an embodiment, in the thermoforming step, pressure of about 5 psi to about 15 psi is applied for about 5 minutes to about 10 minutes.

According to a further broad aspect, there is provided a method of customizing a boot, comprising: (a) measuring a wearer's foot having a tridimensional shape for obtaining numerical data of the tridimensional shape of the wearer's foot; (b) processing the numerical data for obtaining a scanned tridimensional shape of the wearer's foot; (c) transforming the scanned tridimensional shape of the wearer's foot into a tridimensional shape of the foot in a wearing condition; (d) using the tridimensional shape of the foot in the wearing condition for manufacturing medial and lateral side inserts comprising medial and lateral external surfaces and a rear insert comprising a rear external surface wherein the medial and lateral external surfaces define medial and lateral tridimensional shapes and the rear external surface defines a rear tridimensional shape; (e) providing the medial and lateral inserts and the rear insert; (f) selecting the boot with a foot size corresponding to a foot length of the wearer's foot, the boot being at least partially made of a thermoformable material, the boot comprising an inner surface defining an internal space for receiving the wearer's foot; (g) selecting a core having a foot size corresponding to the foot size of the boot; (h) inserting the medial and lateral side inserts, the rear insert and the core in the internal space of the boot such that the core is located between the medial and lateral side inserts and in front of the rear insert and such that the medial and lateral external surfaces of the medial and lateral side inserts contact the inner surface of the boot and the rear external surface of the rear insert contacts the inner surface of the boot; (i) thermoforming the boot such the inner surface of the boot is thermoformed to follow the medial and lateral external surfaces of the medial and lateral inserts and the rear external surface of the rear insert and to define medial, rear and lateral tridimensional shapes complying with medial, rear and lateral shapes of the foot in the wearing condition; and (j) removing the core, the rear insert and the medial and lateral inserts from the boot.

In an embodiment, the inserting step comprises inserting the medial and lateral side inserts and the rear insert before inserting the core in the internal space of the boot.

In an embodiment, before the inserting step, the boot is placed in an oven for pre-softening the 15 thermoformable material, and after the inserting step, the boot is placed in an oven for softening the thermoformable material.

In an embodiment, the pre-softening step comprises placing the boot in an oven at a temperature of about 200° F. to about 300° F. for about 2 minutes to about 5 minutes and the softening step comprises placing the boot in the oven at a temperature of about 200° F. to about 300° F. for about 2 minutes to about 4 minutes.

In an embodiment, in the thermoforming step, the boot is placed on a platform and enclosed in a flexible envelop such that the boot is covered by the envelope and an air-tight seal is obtained between the envelope and the platform and a vacuum is created in the envelope for applying pressure to the boot.

In an embodiment, the core comprises first and second flat surfaces, wherein the medial side insert has a medial flat inner surface opposed to the medial external surface, wherein the lateral side inserts has a lateral flat inner surface opposed to the lateral external surface, and wherein, when the core is located between the medial and lateral side inserts, the first flat surface of the core contacts and follows the medial flat inner surface of the medial side insert and 5 the lateral flat surface of the core contacts and follows the lateral flat inner surface of the lateral side insert.

In an embodiment, the core has a rear flat surface, wherein the rear insert has a rear flat inner surface opposed to the rear external surface, and wherein, when the core is located between the medial and lateral side inserts and in front of the rear insert, the rear flat surface of the core contacts and follows the inner flat surface of the rear insert.

In an embodiment, the measuring step is in a store, the manufacturing step of the medial, rear and lateral side inserts is in a factory and the applying pressure step is in a store.

In an embodiment, each of the medial, rear and lateral side inserts is made by subtractive manufacturing process wherein layers of material are removed from a blank to obtain the tridimensional shape of the external surface of the insert.

In an embodiment, each of the medial, rear and lateral side inserts is made by an additive manufacturing process to obtain the tridimensional shape of the external surface of the insert.

In an embodiment, in the thermoforming step, pressure of about 5 psi to about 15 psi is applied for about 5 minutes to about 10 minutes.

According to a further broad aspect, there is provided a method of customizing a boot, comprising: (a) measuring a wearer's foot having a tridimensional shape for obtaining numerical data of the tridimensional shape of the wearer's foot; (b) processing the numerical data for obtaining a scanned tridimensional shape of the wearer's foot; (c) transforming the scanned tridimensional shape of the wearer's foot into a tridimensional shape of the foot in a wearing condition; (d) using the tridimensional shape of the foot in the wearing condition for manufacturing medial and lateral side inserts comprising medial and lateral external surfaces and medial and lateral flat inner surfaces opposed to the medial and lateral external surfaces and a rear insert comprising a rear external surface, wherein the medial and lateral external surfaces of the medial and lateral side inserts define medial and lateral tridimensional shapes and the rear external surface of the rear insert defines a rear tridimensional shape; (e) providing the medial and lateral inserts and the rear insert; (f) selecting the boot with a foot size corresponding to a foot length of the wearer's foot, the boot being at least partially made of a thermoformable material, the boot comprising an inner surface defining an internal space for receiving the wearer's foot; (g) selecting a core having a foot size corresponding to the foot size of the boot, wherein the core comprises first and second flat surfaces; (h) inserting the medial and lateral side inserts, the rear insert and the core in the internal space of the boot wherein the core is located between the medial and lateral side inserts and in front of the rear insert such that the medial and lateral external surfaces of the medial and lateral side inserts contact the inner surface of the boot and the rear external surface of the rear insert contacts the rear internal surface of the boot and such that the left flat surface of the core contacts and follows the medial flat inner surface of the medial side insert and the second flat surface of the core contacts and follows the lateral flat inner surface of the lateral side insert; (i) thermoforming the boot such that the inner surface of the boot is thermoformed to follow the medial and lateral external surfaces of the medial and lateral inserts and the rear external surface of the rear insert and to define medial, rear and lateral tridimensional shapes complying with medial, rear and lateral shapes of the foot in the wearing condition; and (j) removing the core, the rear insert and the medial and lateral inserts from the boot.

In an embodiment, the core has a rear flat surface, wherein the rear insert has a rear flat inner surface opposed to the rear external surface, and wherein, when the core is located between the medial and lateral side inserts and in front of the rear insert, the rear flat surface of the core contacts and follows the inner flat surface of the rear insert.

In an embodiment, the measuring step is in a store, the manufacturing step of the medial, rear and lateral side inserts is in a factory and the applying pressure step is in a store.

In an embodiment, each of the medial, rear and lateral side inserts is made by subtractive manufacturing process wherein layers of material are removed from a blank to obtain the tridimensional shape of the external surface of the insert.

In an embodiment, each of the medial, rear and lateral side inserts is made by an additive manufacturing process to obtain the tridimensional shape of the external surface of the insert.

In an embodiment, before the inserting step, the boot is placed in an oven for pre-softening the thermoformable material, and after the inserting step, the boot is placed in an oven for softening the thermoformable material.

In an embodiment, the pre-softening step comprises placing the boot in an oven at a temperature of about 200° F. to about 300° F. for about 2 minutes to about 5 minutes and the softening step comprises placing the boot in the oven at a temperature of about 200° F. to about 300° F. for about 2 minutes to about 4 minutes.

In an embodiment, in the thermoforming step, the boot is placed on a platform and enclosed in a flexible envelope such that the boot is covered by the envelope and an air-tight seal is obtained between the envelope and the platform and a vacuum is created in the envelop for applying pressure to the boot.

In an embodiment, in the thermoforming step, pressure of about 5 psi to about 15 psi is applied for about 5 minutes to about 10 minutes.

This and other aspects and features of the subject matter of this application will now become apparent to those of ordinary skill in the art upon review of the following description of specific embodiments and the accompanying drawings.

BRIEF DESCRIPTION OF THE DRAWINGS

Reference is now made to the accompanying figures, in which:

FIG. 1 is a medial side perspective view of a foot of a wearer;

FIG. 2 is a front perspective view of the wearer's foot of FIG. 1;

Figure 3:
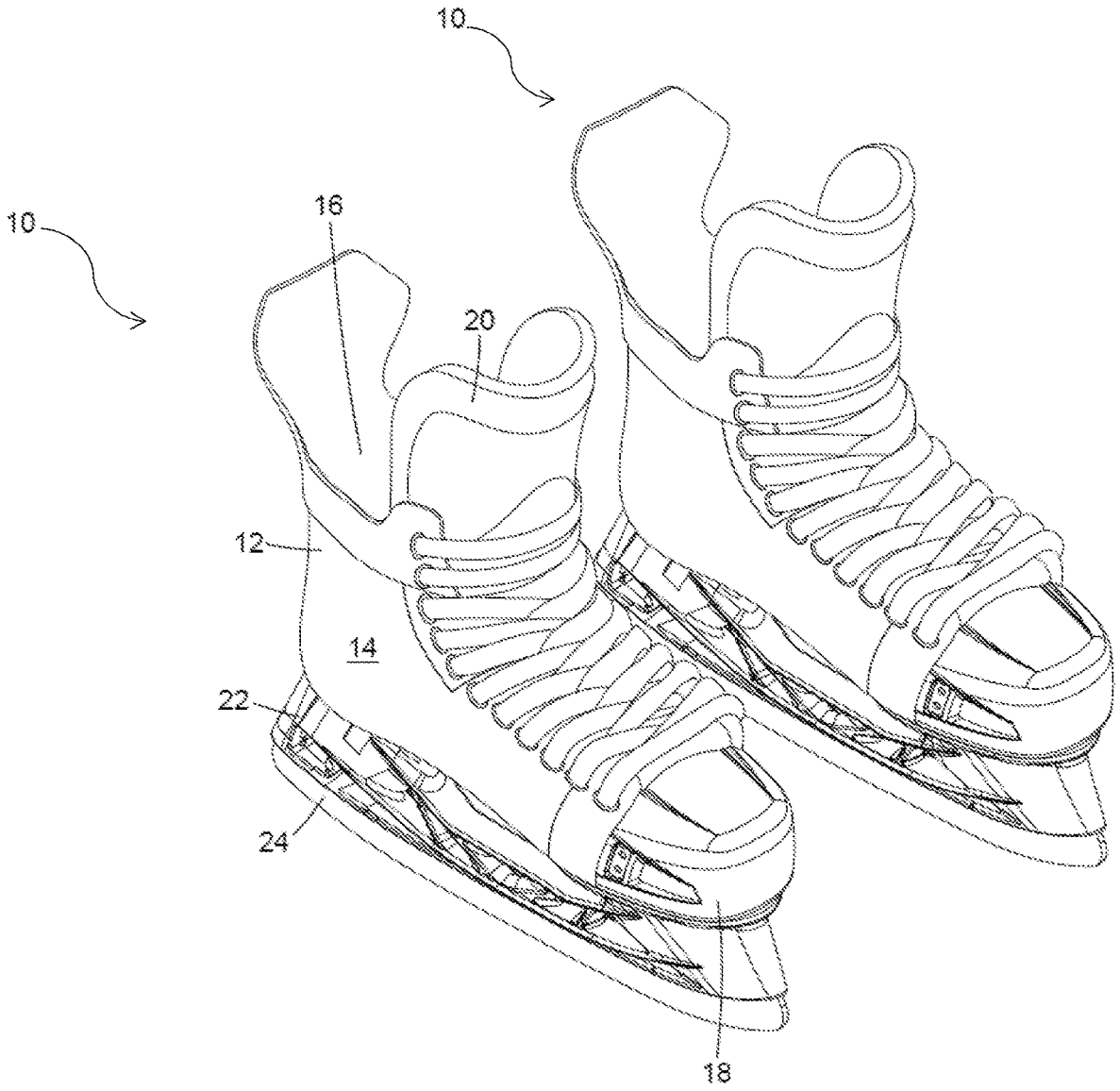
FIG. 3 is a front side perspective view of a pair of skates to be thermoformed with a customizing method according to an embodiment of the present disclosure.
Figure 4A:
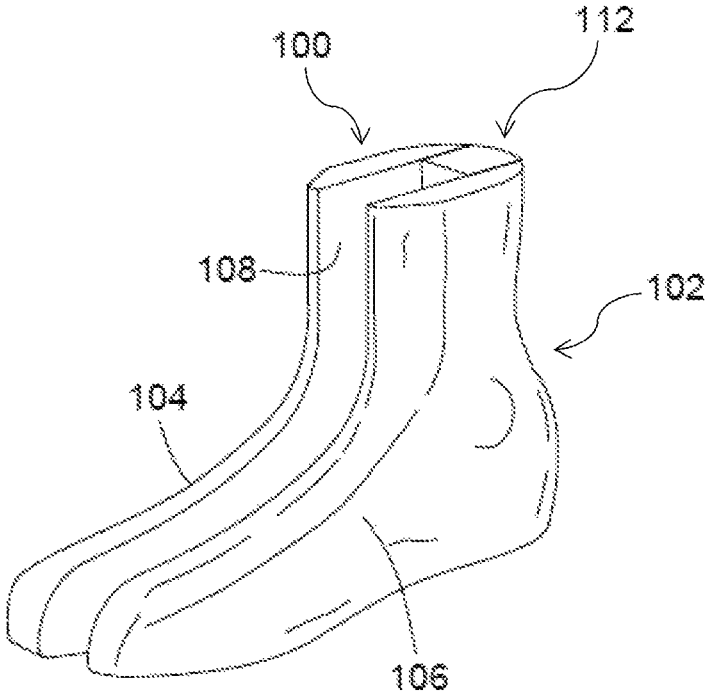
FIGS. 4A and 4B are front and rear side perspective views of medial, rear and lateral inserts used in the method.
Figure 4B:
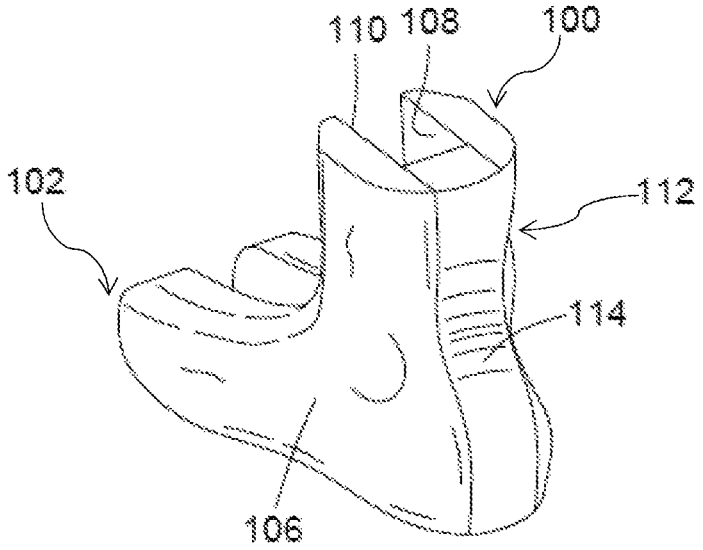
Figure 5B:
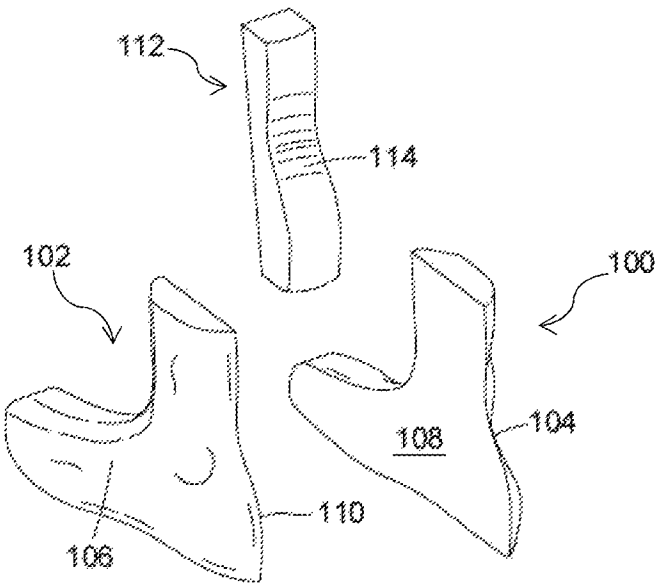
FIGS. 5A and 5B are front and rear side perspective exploded views of the medial, rear and lateral inserts used in the method.
Figure 5A:
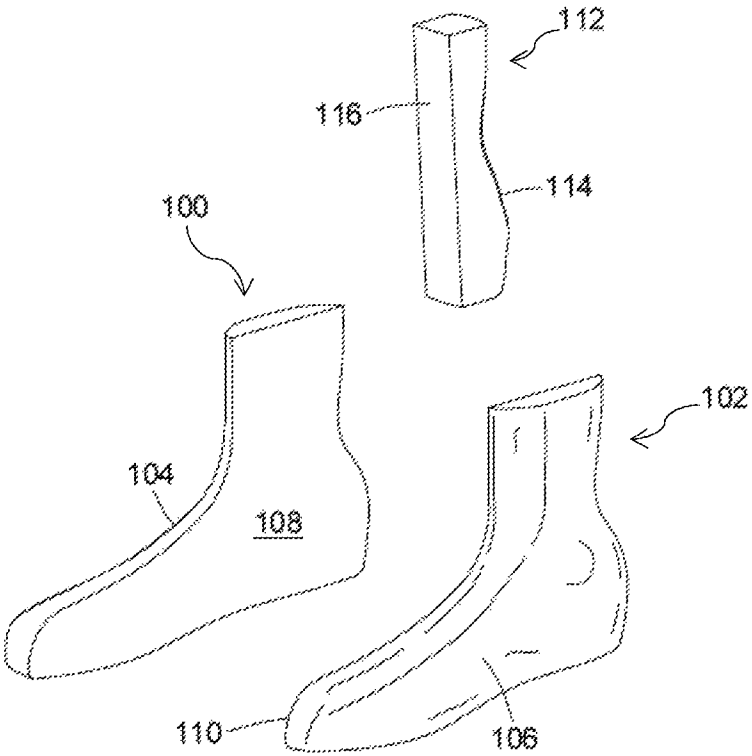

In the drawings, embodiments are illustrated by way of examples. It is to be expressly understood that the description and drawings are only for the purpose of illustration and are an aid for understanding. They are not intended to be a definition of the limits of the embodiments.

DETAILED DESCRIPTION

Before any variants, examples or preferred embodiments are explained in detail, it is to be understood that the present disclosure is not limited in its application to the details of construction and the arrangement of components set forth in the following description or illustrated in the drawings. The present disclosure is capable of other variants or embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional suitable items. Unless specified or limited otherwise, the terms "mounted", "connected", "supported" and "coupled" and variations thereof are used broadly and encompass both direct and indirect mountings, connections, supports and couplings and are thus intended to include direct connections between two inserts without any other inserts interposed therebetween and indirect connections between inserts in which one or more other inserts are interposed therebetween. Further, "connected" and "coupled" are not restricted to physical or mechanical connections or couplings. Additionally, the words "lower", "upper", "upward", "down", "toward" and "downward" designate directions in the drawings to which reference is made. Similarly, the words "left", "medial", "right", "lateral", "front" and "rear" designate locations or positions in the drawings to which reference is made. The terminology includes the words specifically mentioned above, derivatives thereof, and words or similar import.

FIGS. 1 and 2 show a right human foot F of a wearer, the wearer's foot F includes toes T, a plantar surface PS, a top surface TS, a medial side MS (left side of the right foot) and a lateral side LS (right side of the right foot). In addition, the wearer's foot F includes a heel H, an ankle A having a medial side with and a medial malleolus MM, a rear side and a lateral side with a lateral malleolus LM, the lateral malleolus LM being at a lower position than the medial malleolus MM. The rear side has an Achilles tendon AT with an upper part UP and a lower part LP projecting outwardly with relation to the upper part UP, the lower part merging with the heel H.

FIG. 3 shows a pair of left and right ice skates comprising left and right skate boots 10 suitable for enclosing the left and right wearer's feet. Although the boot shown in the figures is a skate boot to be used for an ice skate, it is understood that the herein described methods may also be applied to boots used for roller hockey skates or for other types of footwear that may benefit from customization.

The skate boot 10 has a shell 12 for receiving the wearer's foot F The shell 12 includes an outer surface 14, an inner surface 16 made of rear, medial and lateral inner surfaces and defining an internal space for receiving the wearer's foot, a toe cap 18 made of a rigid material for protecting the wearer's toes T and a tongue 20 extending upwardly and rearwardly from the toe cap 18 for covering a forefoot of the wearer's foot F. The inner surface 16 may comprise an inner liner having a surface adapted to contact the wearer's foot F or a sock covering the wearer's foot F. The skate boot 10 has an ice skate blade holder 22 and an ice skate blade 24. The skate boot 10 may comprise a footbed with an upper surface for facing the plantar surface PS of the wearer's foot F. The skate boot 10 may further include a tendon guard 26 positionable above a rear portion of the ankle A of the wearer's foot F.

The shell 12 is made at least partially of a thermoformable material. As used herein, the expression "thermoformable material" refers to a material that is capable of softening when heated and of hardening again when cooled, either by actively cooling the material or by allowing the material to return to room temperature after being heated. Some non-limiting examples of different types of thermoformable material comprise ethylene vinyl acetate (EVA) foam, polyethylene foam, polystyrene foam, polypropylene foam and polypropylene weave, sold under various names such as MEGABIX™, SURLYN™, SONTARAR™, FORMO500™, BYLON™, MOSOCA™, NYLON™ 66, CURVE™ and PURE™.

The shell 12 may be made of a single sheet of a thermoformable material comprising one, two or three layers made. In one variant, the layer that forms part of the outer surface 14 of the shell 12 is more rigid that the layer that forms part of the inner surface 16 of the shell 12. A layer of thermoformable foam may be located between the outer and inner layers. In one variant, the shell 12 is made of a single sheet made of thermoformable material. However, it should be understood that the shell 12 could also be made of multiple sections. For example, the shell 12 could be made from separate medial and lateral side portions that are affixed together. The herein described methods may be used for a lasted boot as well as a non-lasted boot.

The methods of customizing boot according to various embodiments of the present disclosure first includes obtaining numerical data of the tridimensional shape of the wearer's foot. This may include, but is not limited to, scanning the tridimensional shape of the wearer's foot F to obtain the numerical data of the tridimensional shape of the wearer's foot F. Thus, a tridimensional digital representation of the wearer's foot can be generated, by obtaining and then processing the numerical data obtained by the scanning of the foot.

In the case where the wearer's foot is first scanned (e.g. if the wearer's foot has not previously been scanned), a tridimensional foot scanner such as an optical laser scanning system may be used to scan the wearer's foot F and to obtain scanned foot data for several measuring points and items (e.g. foot length, ball girth circumference, foot size, instep circumference, heel size, instep length, etc.). Various foot scanners, for instance those sold by Occipital, Inc., may be used to measure the tridimensional shape of the wearer's foot F. For instance, in a store selling athletic footwear, an operator such as a salesman may use the foot scanner to scan the left foot of the wearer (i.e. the customer) and the then right foot of the wearer (or vice-versa). The foot scanner may be connected to a computer such that the scanned data or numerical data are stored, for instance remotely via the cloud, in an appropriate location for this specific wearer (customer). In various embodiments, certain regions of the foot F having a greater impact on the customization on the boot 10 are pre-identified, and only these regions are scanned.

The numerical data are then processed, for instance via a third party application, for obtaining a scanned tridimensional shape of the wearer's foot F. This processing step may also be performed by the scanning system and/or software.

In addition, with a suitable algorithm or computer program, the scanned tridimensional shape of the wearer's foot F is transformed into a tridimensional shape of the foot F in a wearing condition. It is understood that the wearing condition is a condition or position that generally corresponds to the condition or position of the foot F when the foot F is in the skate boot 10. Such a position may include the heel H and a proximal region of the plantar surface PS being slightly higher than a distal region of the plantar surface PS and the toes T. In that sense, the expression "wearing condition" encompasses a condition or a position of the foot F when the foot F is in the skate boot 10 or when the foot F is in a "skating condition" or a "skating position".

Alternatively, the foot F may be scanned while already in a wearing condition, negating the need to transform the initially scanned tridimensional shape of the wearer's foot F into the tridimensional shape of the foot F in the wearing condition. For instance, the wearer (i.e. the customer) may place their foot F on a designated pad or platform (not shown) mimicking the sole of a typical skate boot 10. This pad or platform may be configured to replicate the position of a foot F in the wearing condition, for example with the heel H and a proximal region of the plantar surface PS being slightly higher than a distal region of the plantar surface PS and the toes T. As such, the foot F may be scanned in the wearing position used to eventually customize the boot 10, as will be discussed in further detail below.

The tridimensional shape of the foot F in the wearing condition is then used for manufacturing medial and lateral side inserts 100, 102, as per various methods of manufacturing taught by the present disclosure. Referring to FIGS. 4A to 5B, the medial and lateral side inserts 100, 102 comprise medial and lateral external surfaces 104, 106 defining medial and lateral tridimensional shapes and medial and lateral inner surfaces 108, 110 opposed to the medial and lateral external surfaces 104, 106. In one variant, the medial and lateral inner surfaces 108, 110 are medial and lateral flat inner surfaces. The method may also comprise using the tridimensional shape of the foot F in the wearing condition to manufacture a rear insert 112 comprising a rear external surface 114 that defines a rear tridimensional shape and a rear inner surface 116 opposed to the rear external surface 114. In one variant, the rear inner surface 116 is a rear flat inner surface.

It is understood that the medial and lateral tridimensional shapes of the medial and lateral side inserts 100, 102 correspond to the medial MS, MM and lateral LS, LM tridimensional shapes of the foot F in the wearing condition and that the rear tridimensional shape of the rear insert 112 corresponds to the rear UP, LP, H tridimensional shape of the foot F in the wearing conditioning. Rear insert 112 is said to be optional, as in some embodiments the rear portions of side inserts 100, 102 may offer a sufficient level of customization to represent the heel portion H of the wearer's foot H.

It is also understood that the medial and lateral tridimensional shapes of the medial and lateral side inserts 100, 102 may not include the medial and lateral shapes of the wearer's toes T. Indeed, for a boot such as a skate boot that comprises a rigid toe cap 18 for covering and protecting the toes T, this toe cap 18 may not be part of the customizing process of the boot and the distal ends of the medial and lateral side inserts 100, 102 may each end before the toes T.

Figure 6:
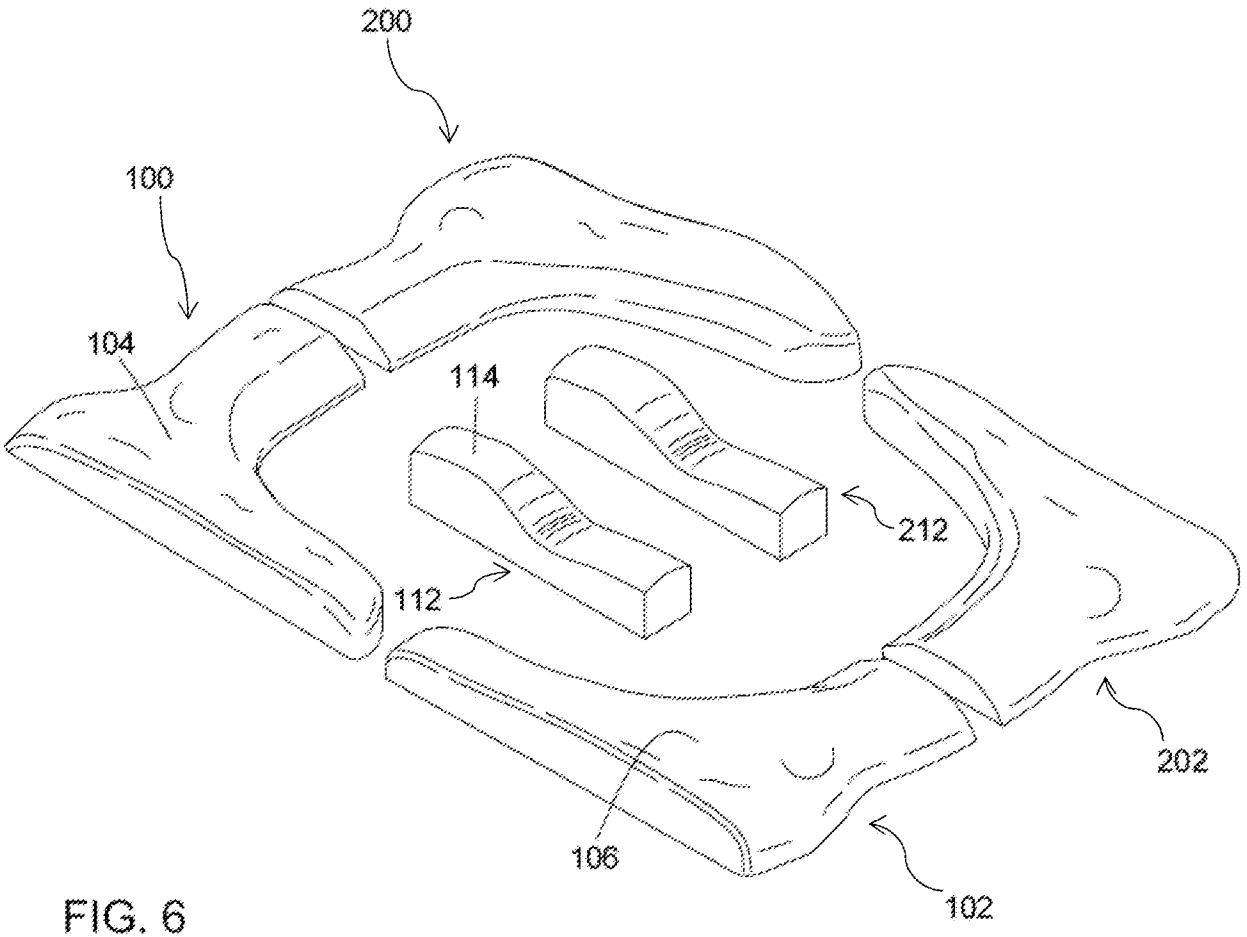
FIG. 6 is a top perspective showing a pair of the medial, rear and lateral inserts used in the method.

As seen in FIG. 6, the medial and lateral side inserts 100, 102 and the rear insert 112 may be the inserts to be used in the thermoforming process of the left skate boot and medial and lateral side inserts 200, 202 and a rear insert 212 may be the inserts to be used in the thermoforming process of the right skate boot. It is understood that the inserts 100, 102, 112, 200, 202, 212, which may also be referred to as members, may be manufactured in a factory. In such embodiments, the factory may receive data corresponding to the tridimensional shape of the foot or feet F in the wearing condition and manufacture the various inserts 100, 102, 112, 200, 202, 212 based on this data. In one variant, each of the inserts 100, 102, 112, 200, 202, 212 is made by subtractive manufacturing process wherein layers of material are removed from a blank to obtain the tridimensional shape of the external surface of the insert. In another variant, each of the inserts 100, 102, 112, 200, 202, 212 is made by an additive manufacturing process to obtain the insert with the tridimensional shape of the external surface of the insert. Each of the inserts 100, 102, 112, 200, 202, 212 may be made of a suitable rigid material such as polyurethane foam.

In a further step, the inserts 100, 102, 112, 200, 202, 212 are provided to the operator who can be in the store. The operator then selects a skate boot 10 among the skate boots or skates that are already in the store, the selected skate boot or skate having a foot size substantially corresponding to a foot length of the wearer's foot F. As indicated previously, the skate boot 10 is at least partially made of a thermoformable material and the boot 10 has an inner surface 16 defining an internal space for receiving the wearer's foot F.

Referring to FIG. 7A-7D, a core 118 is also used in the method of thermoforming the skate boot. The core is configured to be inserted along with the medial, lateral and optional rear inserts 100, 102, 112, either simultaneously or sequentially, in the skate boot 10 to customize the boot 10 to conform to the shape of the wearer's foot F in the wearing condition, as will be discussed in further detail below. According to the present disclosure, a kit is taught for customizing a thermoformable boot, the kit including the core 118 as well as inserts 100, 102; 200, 202 and optionally 112; 212.

In one variant, the core 118 comprises a top portion TP and a bottom portion BP. The bottom portion BP may include first and second flat surfaces 120, 122 and a rear flat surface 124. The core 118 is made of a suitable rigid material such as plastic, wood, aluminum, steel or stainless steel. As indicated above, each of the inserts 100, 102, 112, 200, 202, 212 may be made of a suitable rigid material such as polyurethane foam. In one variant, the core 118 is made of a material that is at least as rigid as the material of the inserts. Each core 118 may include dimensions such as a length L of the bottom portion BP, an overhang length L' of the top portion TP, a width W of the bottom portion BP and a height H of the bottom portion BP.

The core 118 may have a foot size corresponding to the foot size of a corresponding skate boot 10. In this regard, the core 118 may be selected among a group of cores 118 each corresponding to a range of standardized foot sizes. The group may include, for instance, a first core with a first foot size, for instance for boot foot sizes 4 to 6, a second core with a second foot size, for instance for boot foot sizes 7 to 9, and a third core with a third foot size, for instance for boot foot sizes 10 to 12. In that sense, it is understood that the same core 118 may be compatible with a range of boot foot sizes. As such, while a given store may wish to maintain in stock the same skate boot 10 in a variety of sizes, they would only need to possess a smaller number of cores 118 to ensure that the herein-described method may be carried out for each size skate boot 10. The phrase "a core having a foot size corresponding to the foot size of the boot" thus encompasses a core 118 having a suitable foot size such that the core 118 is adapted to be inserted in boots 10 with different foot sizes.

As will be discussed in further detail below, the core 118 is to be inserted in a given boot 100 such that it is straddled by inserts 100, 102 (or 200, 202) on either side. It is therefore understood that the core 118 is suitably sized such that there is a snug or tight fit between the core 118 and inserts 100, 102, 112, 200, 202, 212 and the inner surface 16 of the boot 10 once the core 118 and inserts 100, 102, 112, 200, 202, 212 are inserted in the boot 10 and such that the external surfaces of the medial 100, 200 and lateral 102, 202 side inserts, and of the optional rear insert 112, 212, contact the inner surface 16 of the boot 10. If no rear insert 112, 212 is used, it is understood that the length of the core 118 should be sufficiently long such that the rear surface 124 of the core 118 contacts the inner surface 16 of the boot 10. The front end of the selected core 118 should be substantially flush with the ends of inserts 100, 102, 200, 202 once inserted into the boot 10. However, other lengths of the selected core 118 may be considered as well. The overhang portion L' of the top portion TP of the core may accommodate the optional rear insert 112, 212. As such, if the rear insert 112, 212 is not utilized, a core 118 with no top portion TP with overhang portion L' may be used instead. In addition, a core 118 may be selected such that its width W is narrow enough to fit into the one or more boots 10 being customized yet large enough to reduce the amount of material needed for inserts 100, 102, 200, 202, which in turn renders the insertion of inserts 100, 102, 200, 202 into the boot 10 easier.

As each potential wearer's foot F is sized and shaped differently, it is also understood that the same core 118 may be used for thermoforming skate boots 10 of different sizes while an infinite number of inserts 100, 102, 112, 200, 202, 212 may be used to comply with an infinite number of foot shapes, subject to the number of wearers undergoing the herein described customization method. In other words, while a limited number of cores is needed and used in the method (e.g. first, second and third cores for foot sizes 4-6, 7-9 and 10-12), each insert is customized (manufactured) to comply to the specific shape or anatomy of a specific wearer's foot in a wearing condition.

One will recognize that the use of the core 118 and the customized medial and lateral inserts 100, 102 (and rear insert 112) allows to reduce the cost and the amount of material for manufacturing an entire replica of the wearer's foot F each time a core is required to customize a skate boot 10 according to the specific shape or anatomy of a specific wearer's foot F in a wearing condition. In other words, only a limited amount of standardized cores 118 will need to be manufactured, and the material needed to manufacture each customized medial and lateral inserts 100, 102 (and rear insert 112) will be less than the material needed to manufacture an entire replica of the wearer's foot F.

As discussed above, the core 118 has a top portion TP that is not located in the boot cavity once the core 118 is inserted in the boot 10. As such, the height H of the bottom portion should be great enough to allow the top portion TP to be positioned above the boot cavity. More particularly, this top portion TP is at least partially located between the tendon guard 26 and the tongue 20. During the thermoforming step, the tendon guard 26 and tongue 20 may abut against this top portion TP such that the tendon guard 26 and tongue 20 would remain substantially in a desired position. The top portion TP may provide added structure and support during various steps of the customization method, as will be described in further detail below.

The medial side insert 100, lateral side insert 102 and the optional rear insert 112 cooperate to reflect the actual shape of the wearer's foot F in the wearing condition once they are inserted into the skate boot 10, as will be discussed in further detail below. As only the external surfaces of the inserts 100, 102 and 112 are needed to define the shape of the wearer's foot F, the core 118 is a standardized component that may be used for different wearers having similarly sized feet. In an embodiment, the cores 118 are shaped as rectangular prisms with flat sides that are perpendicular to their adjacent sides. Other shapes for the cores 118 may be considered as well.

Certain parts of the skate boot 10 are not thermoformed, for instance the toe cap 18 (as discussed above). In addition, certain portions of the wearer's foot may be disregarded and replaced with a neutral shape, such as the underside of the wearer's foot F, the upper portion of the wearer's foot F which will abut against the tongue 20 when in use, or portions of the ankle A above the malleolus. As mentioned above, the regions of the foot F needed for the customization of the boot 10 may be pre-identified so that only these regions may be scanned. As such, regions that do not play a role in the customization of the boot 10, such as the toes T or the underside of the foot F, need not be scanned in detail.

Figure 7A:
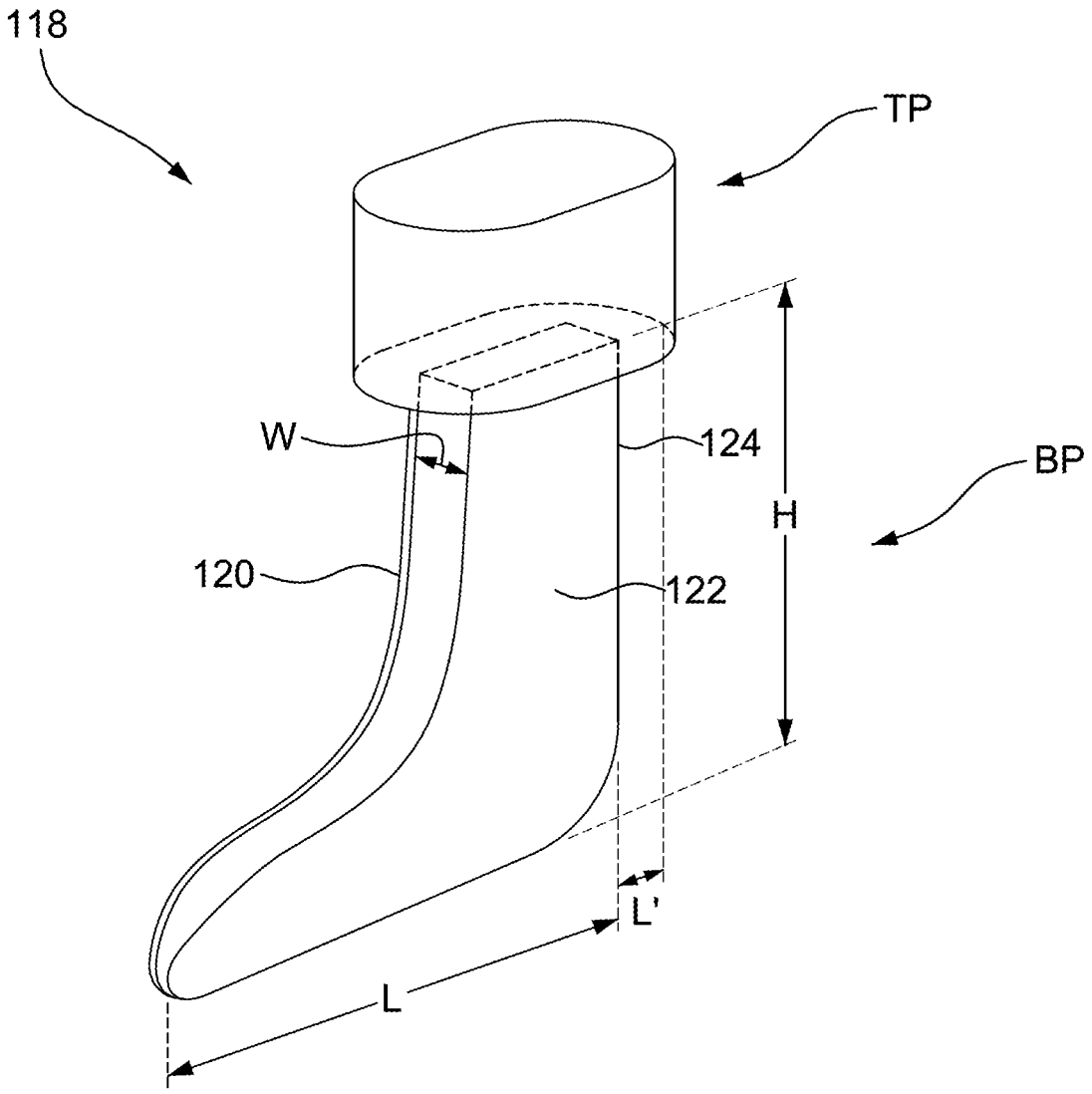
FIG. 7A is a front side perspective view of a core used in the method.
Figure 7B:
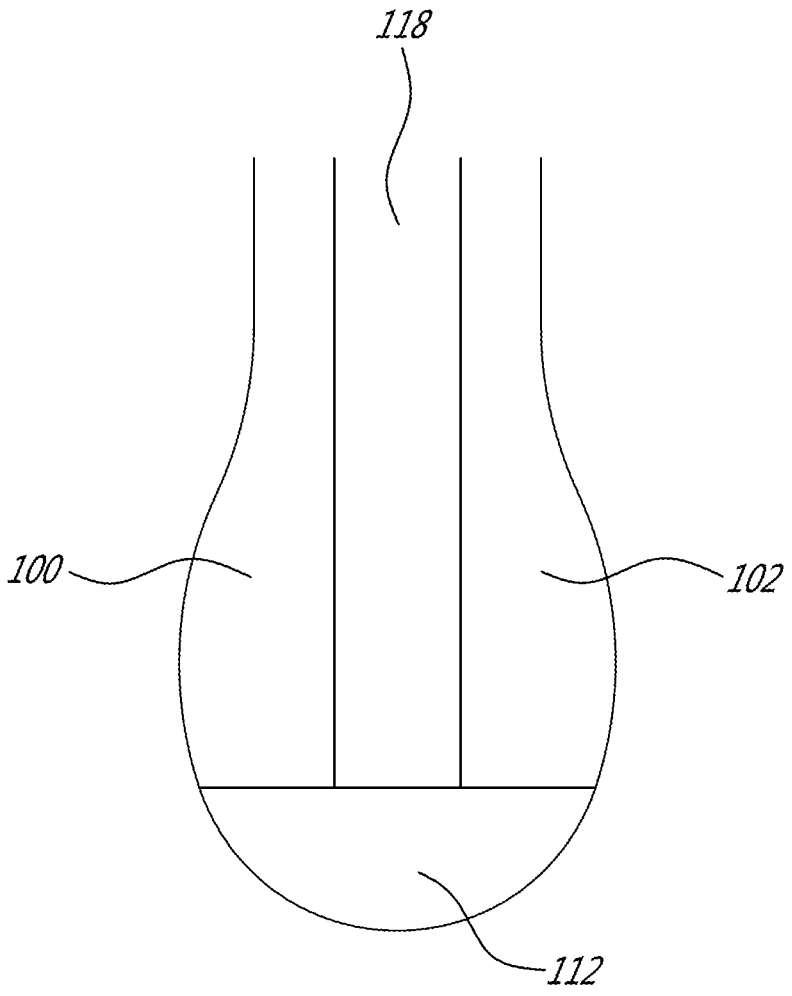
FIGS. 7B-7D are underside views of various cores and medial, lateral and optional rear inserts used in the method.
Figure 7C:
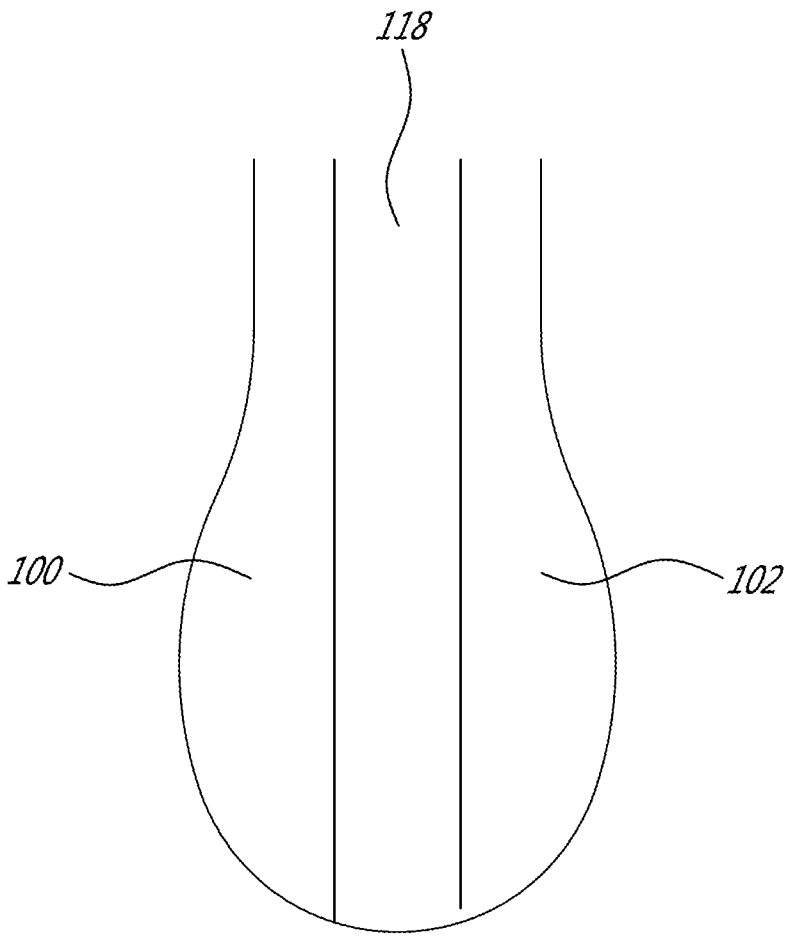
Figure 7D:
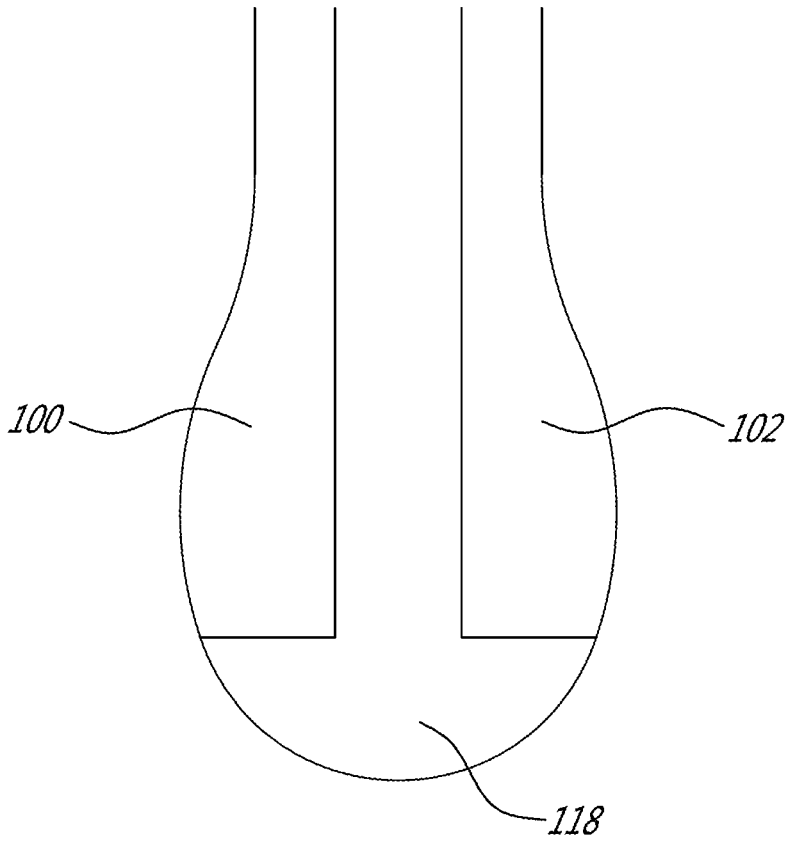

As shown in FIG. 7B, the core 118 may be straddled on either side by the medial and lateral inserts 100, 102 and abut the rear insert 112 at a distal end thereof. As shown from the below in FIG. 7B, the core 118 is shown to have a substantially rectangular shape. The core 118 is shown to have substantially flat outer walls to facilitate mating with the medial and lateral flat inner surfaces 108, 110 and the rear inner surface 116. In cases where the rear insert 112 is not provided, as shown in FIGS. 7C and 7D, the core 118 may have two substantially parallel walls mating with the inserts 100, 102 (as shown in FIG. 7C) and a slightly rounded endwall configured to follow the curvature of the rear of a typical skate boot 10. Conversely, as shown in FIG. 7D, the core 118 may be shaped in a T-like fashion with two corners configured to receive the inserts 100, 102 and include a rounded endwall to follow the curvature of a typical skate boot 10. Other designs for the core 118 may be considered as well.

Referring now to FIGS. 8-20, there is shown a machine 300 used in the method of thermoforming the skate boot 10, according to an embodiment of the present disclosure. The machine has a platform 302 and an oven 304, whereby the platform 302 is descended into the oven 304. Other configurations may be considered, for instance a platform 302 positioned on a side of the oven 304 and translatable through the oven 304. In such embodiments, the oven 304 may be open at one side only and the platform 302 is retractable in and out of the oven 304. Conversely, the oven 304 may be open at two opposite sides thereof and include a conveyer belt passing therethrough. Other configurations may be considered as well.

Figure 8:
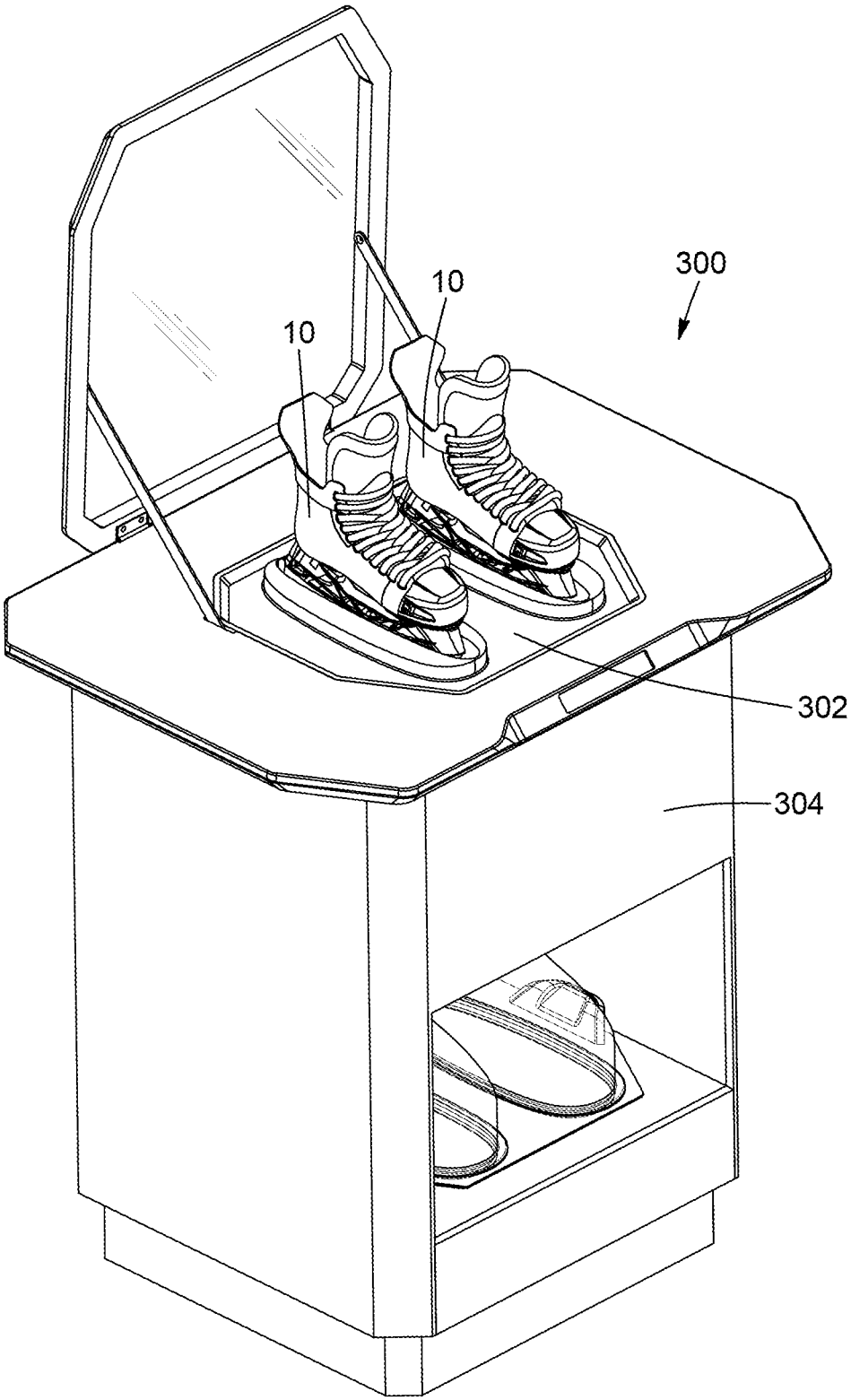
FIGS. 8 to 20 show a machine used for customizing and thermoforming the pair of skates at different steps of the method.

In the embodiment shown in FIG. 8, the left and right skates 10 are placed by the operator on the platform 302.

It is understood that a single skate 10, a pair of skates 10, or more than a pair of skates 10 may be thermoformed in various configurations of the machine 300.

In addition, instead of an operator, it is understood that a robot or any other automated means may be used in the method. As such, in the following method steps, any step described as being carried out by an operator may instead be carried out by such a robot or other automated means.

Figure 9:
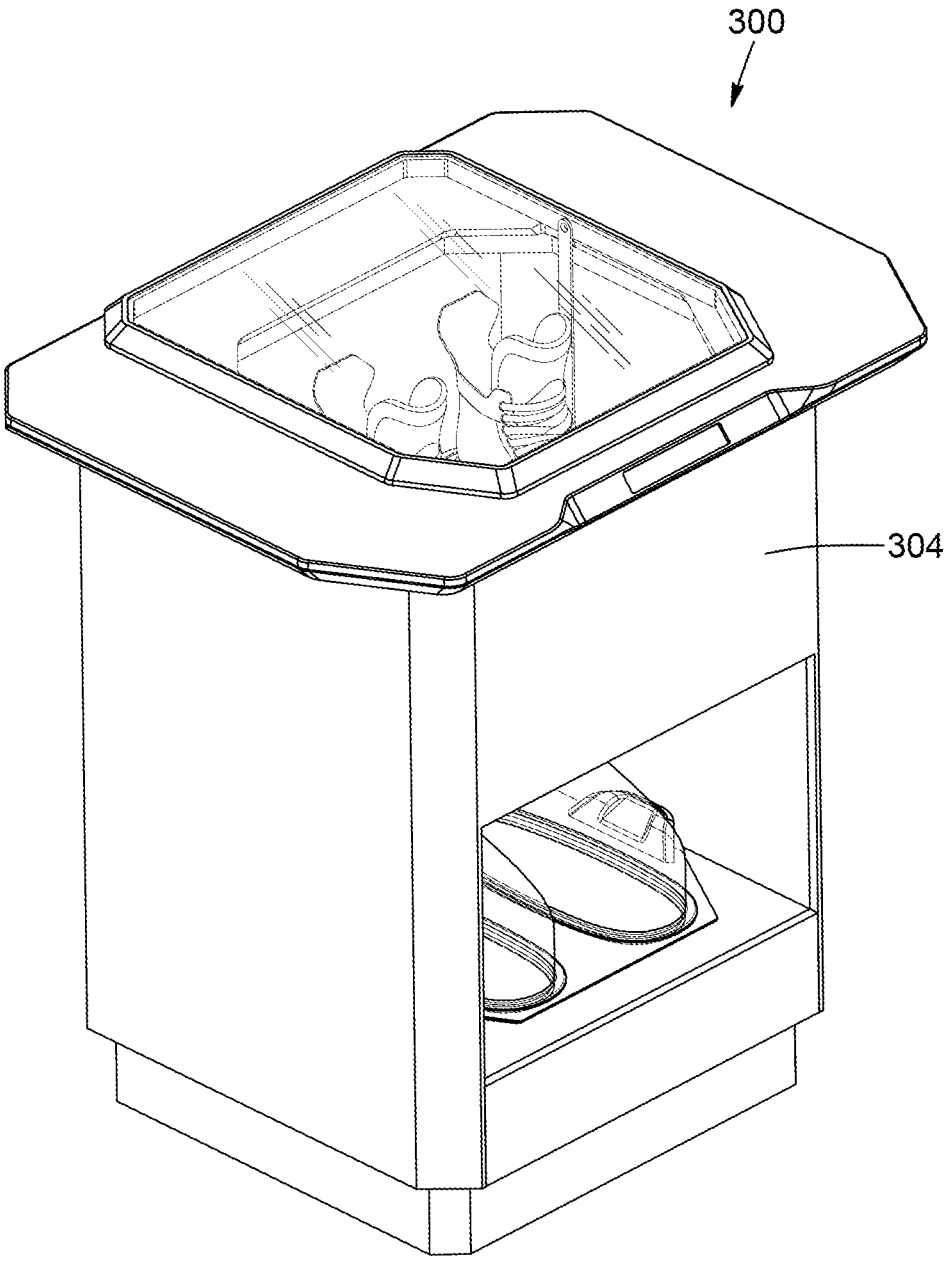

Referring to FIG. 9, the operator then operates the machine 300 such that the platform 302 descends into the oven 304. The left and right ice skates then remain in the oven 304 that is set at a temperature of about 200° F. to about 300° F. for about 2 minutes to about 5 minutes. This step, which may be optional, is used for pre-softening the thermoformable material of each skate boot. The duration and chosen temperature for this step may vary, for instance, due to the specific materials of the skate(s) 10 undergoing customization. Pre-softening the boot(s) 10 may facilitate the insertion of the various inserts 100, 102, 112, 200, 202, 212 and core 118 in the subsequent steps. Pre-softening the boot(s) 10 may also, among other advantages, decrease the time needed to thermoform the boot(s) 10 in subsequent steps.

Figure 10:
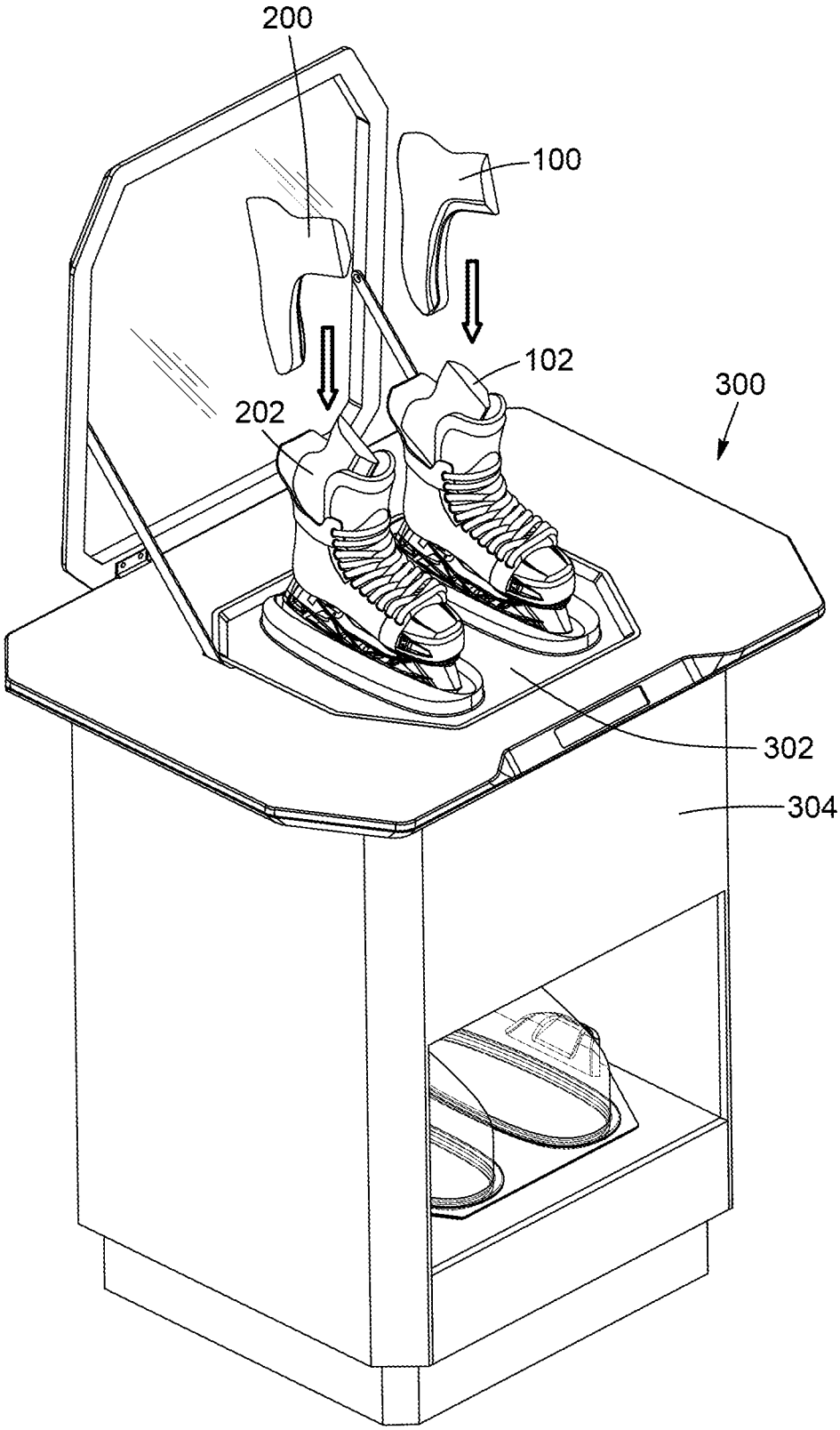
Figure 11:
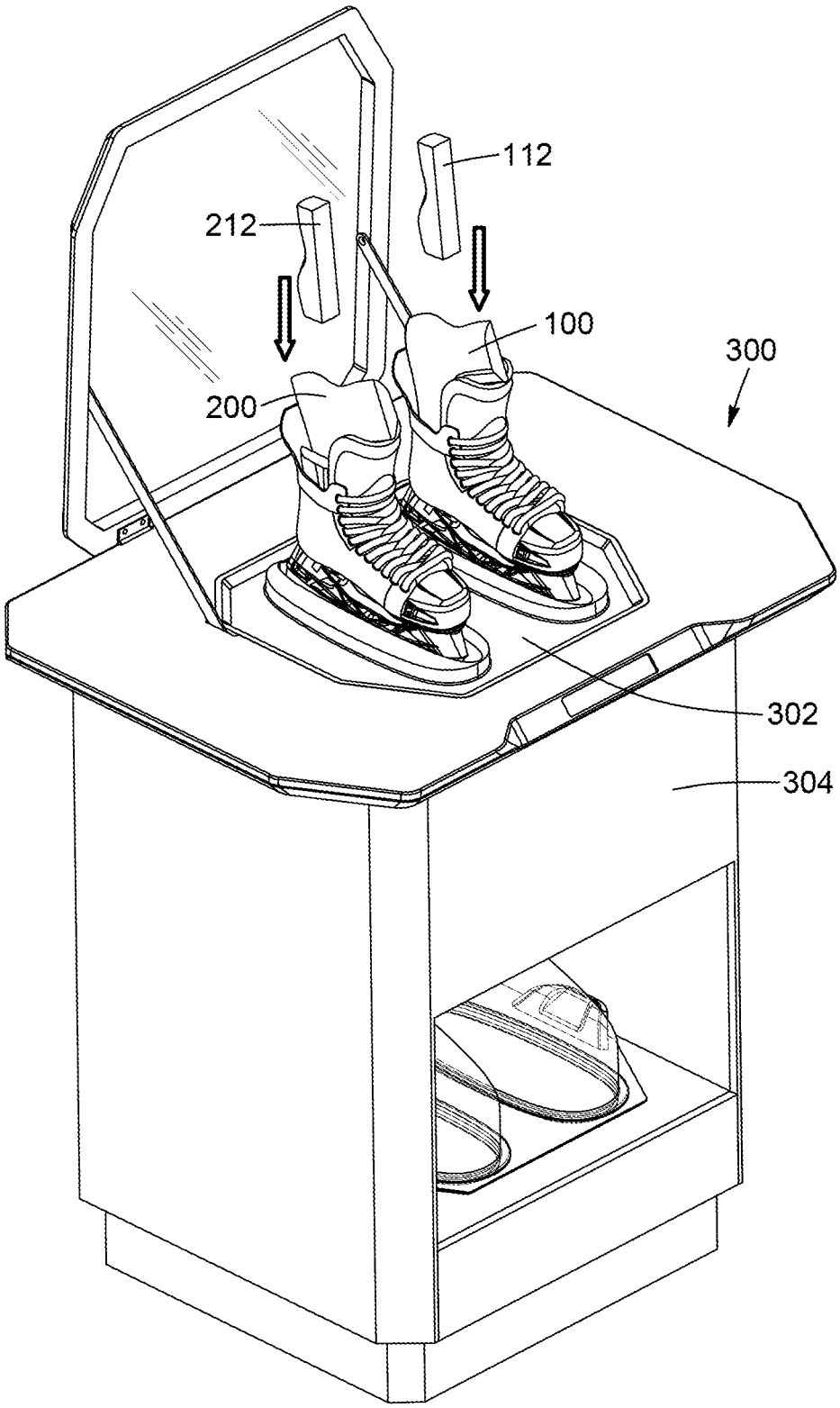
Figure 12:
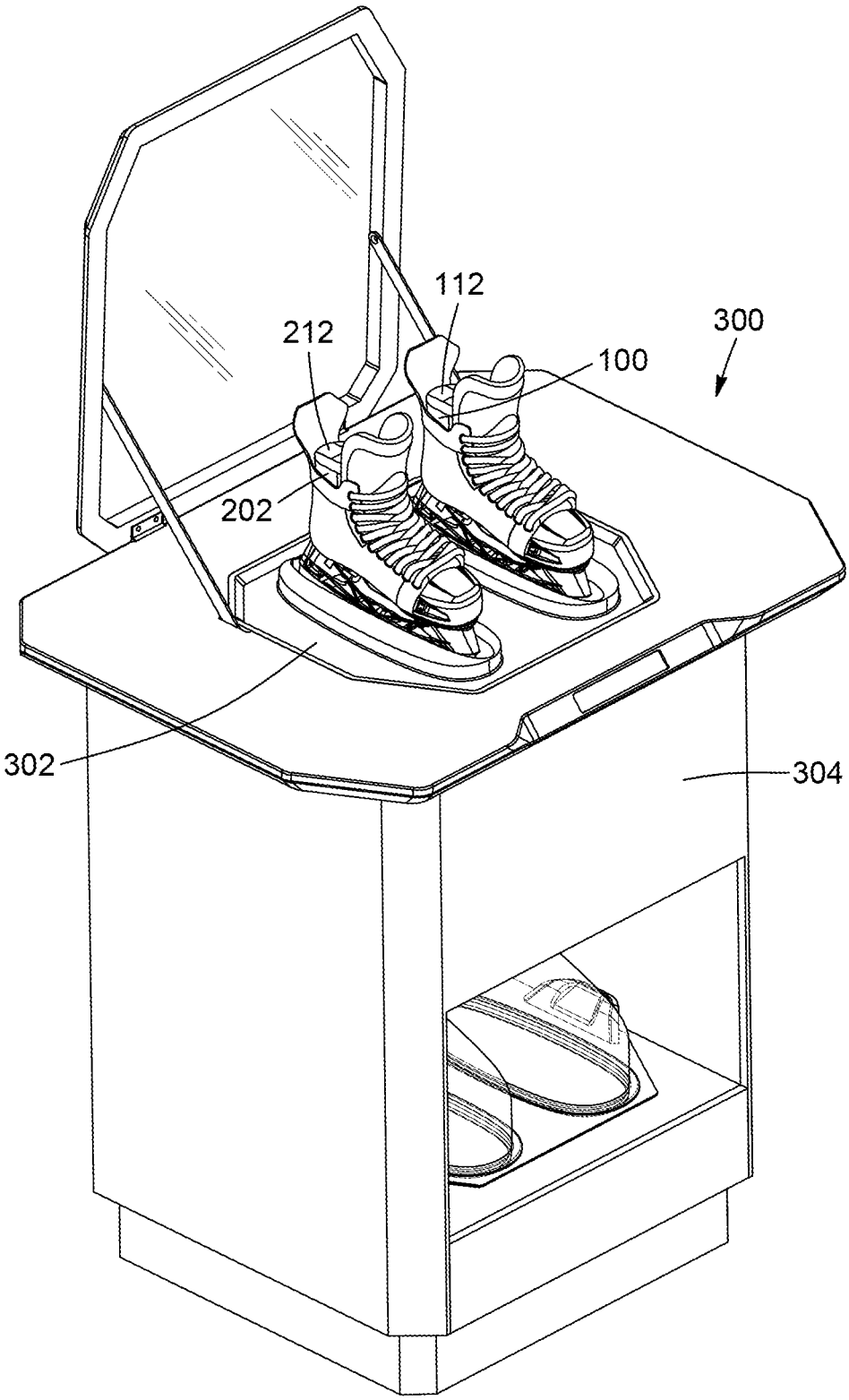

Referring to FIG. 10, after the skates 10 have been optionally pre-softened and removed from the oven 304 (the platform 302 may have returned to its initial position after a predetermined amount of time (e.g. 2 minutes to about 5 minutes)), the medial and lateral side inserts 100, 102; 200, 202 are inserted (by the operator) into the skates 10. Such insertion may be done sequentially, as in one at a time, or concurrently, so that they are inserted together and then adjusted as needed. If the method also comprises the use of the rear inserts 112, 212, as seen in FIGS. 11 and 12, the rear inserts 112, 212 are inserted (by the operator) in the skates 10 as well.

Figure 13:
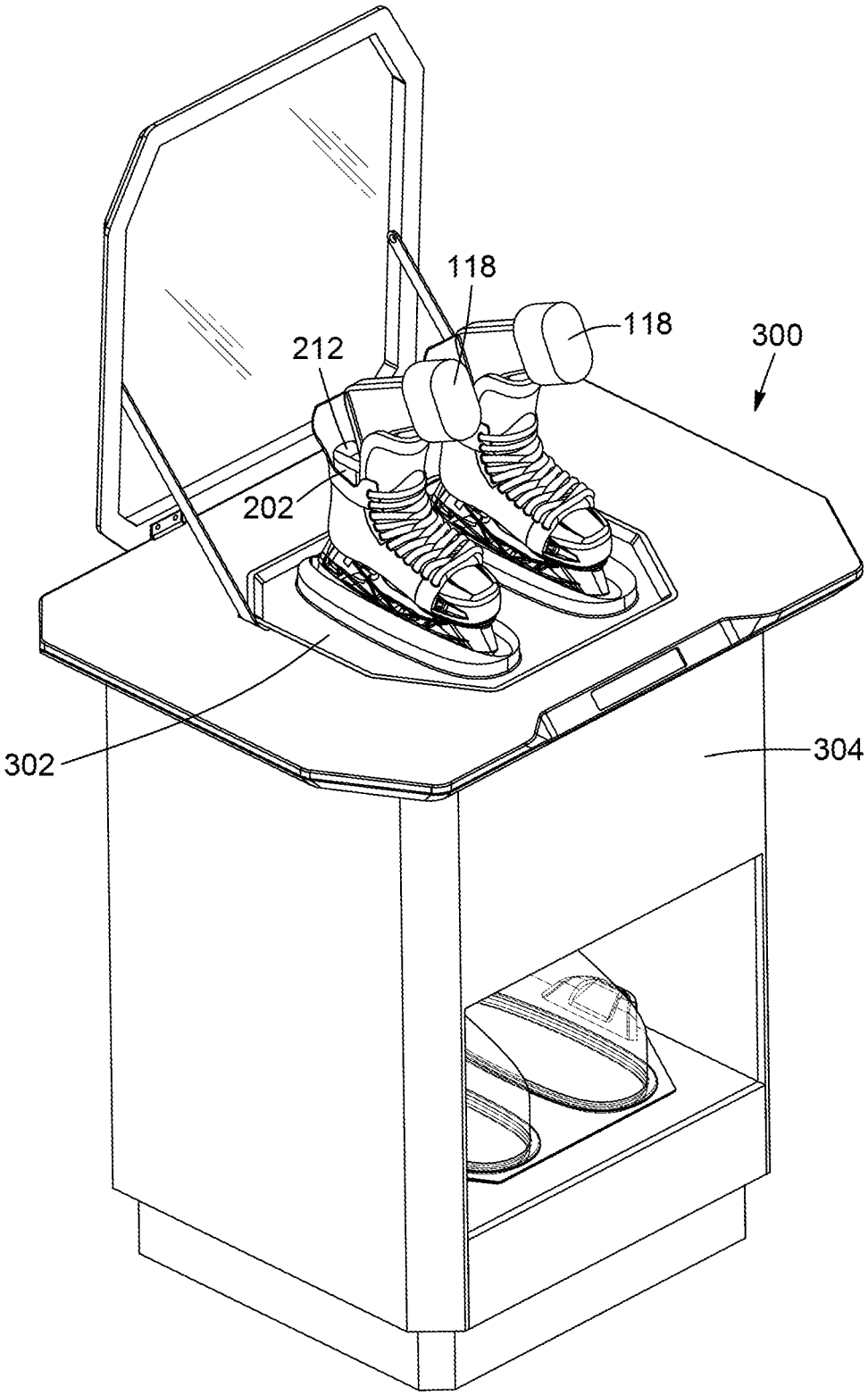
Figure 14:
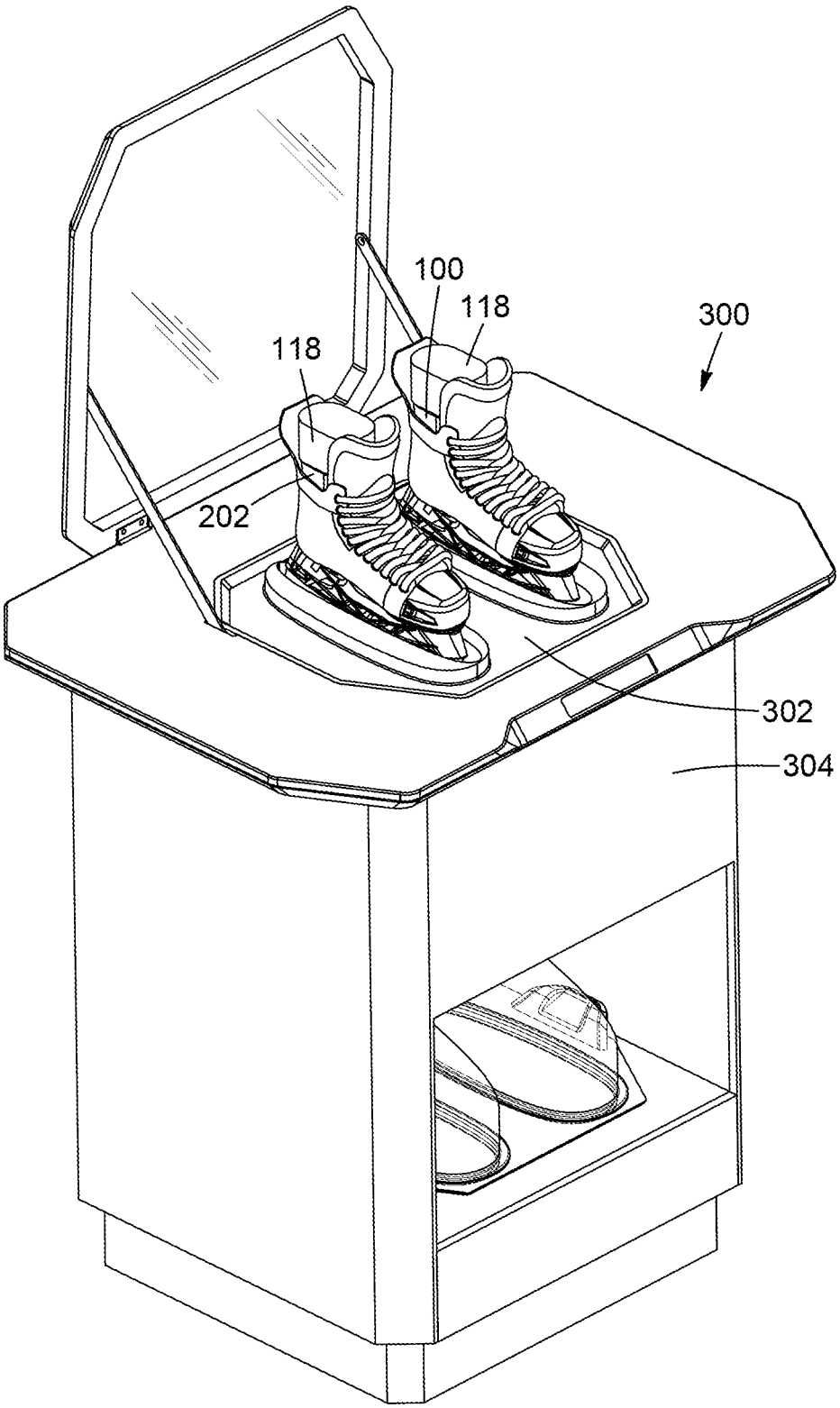

Referring to FIGS. 13 and 14, the core 118 is inserted (by the operator) in each of the internal spaces of the skate boots 10 such that each core 118 is located between the medial and lateral side inserts 100, 102 and in front of the rear insert 112 (if present), such that the medial and lateral external surfaces 104, 106 of the medial and lateral side inserts 100, 102 contact the inner surface 16 of the skate boot 10 (in the medial and lateral regions) and the rear external surface 114 of the rear insert 112 contacts the inner surface 16 of the skate boot 10 (in the rear region) and such that the first flat surface 120 of the core 118 contacts and follows the medial flat inner surface 108 of the medial side insert 100, the second flat surface 122 of the core 118 contacts and follows the lateral flat inner surface 110 of the lateral side insert 102, and the rear flat surface 124 of the core 118 contacts and follows the rear flat inner surface 116 of the rear insert 112. As such, surfaces 120, 122 of the core 118 may be substantially flat, although other configurations may be considered so that the surfaces 120, 122 mate with the internal surfaces 108, 110 of inserts 100, 102, respectively.

Figure 15:
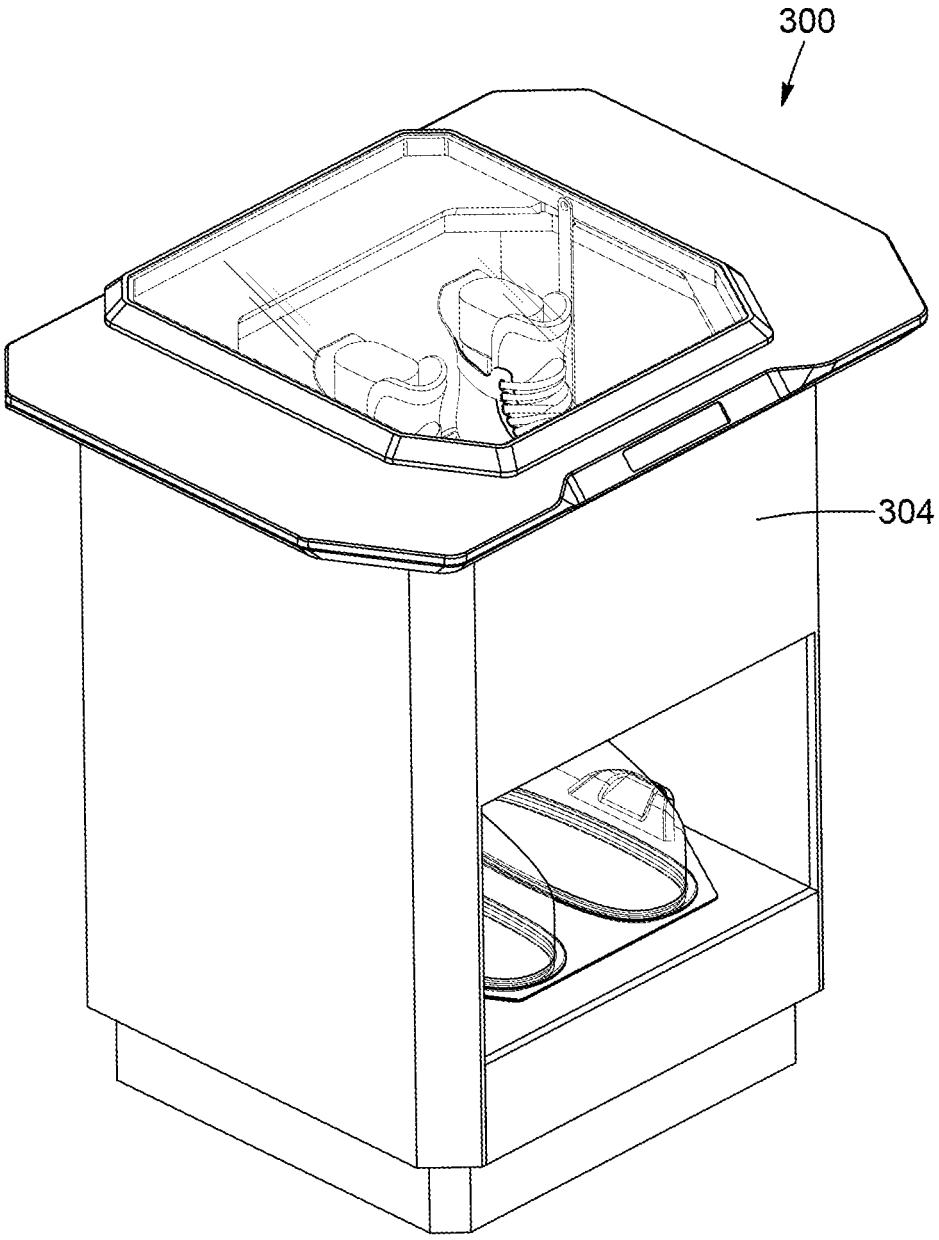
Figure 16:
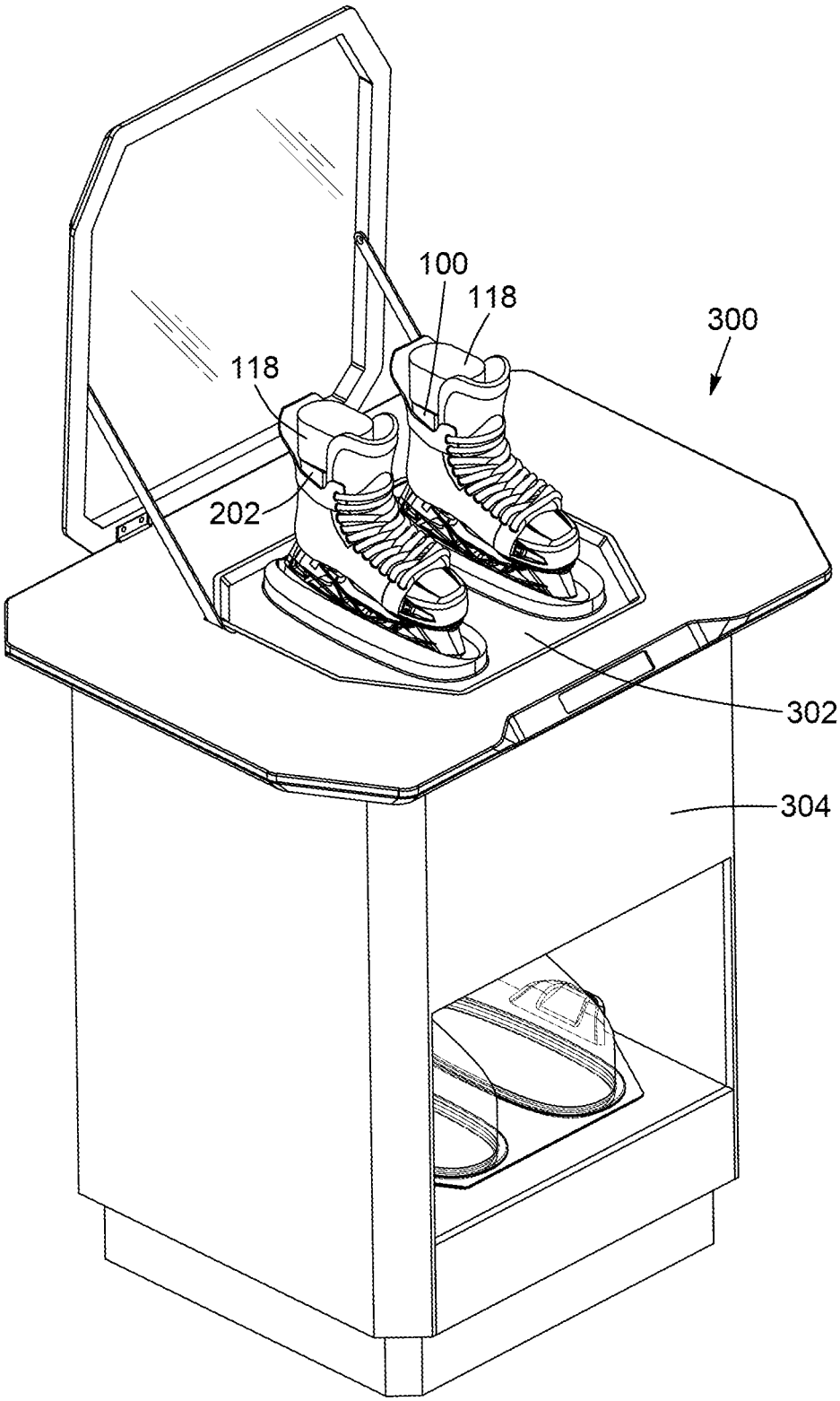

Referring to FIG. 15, the operator operates again the machine 300 such that the platform 302 descends into the oven 304 to soften the skates 10. The left and right ice skates 10 then remain in the oven 304 that is set at a temperature of about 200° F. to about 300° F. for about 2 minutes to about 4 minutes for softening the thermoformable material of each skate boot. As was the case with the pre-softening step, the duration and chosen temperature for this step may vary, for instance, due to the specific materials of the skate(s) 10 undergoing customization Referring to FIG. 16, the skates 10 are shown after having been softened and removed from the oven 304, the platform 302 having returned to its initial position after a predetermined amount of time (e.g. 2 minutes to about 4 minutes). As discussed above, other configurations for the platform 302 and oven 304 may be considered as well.

Figure 17:
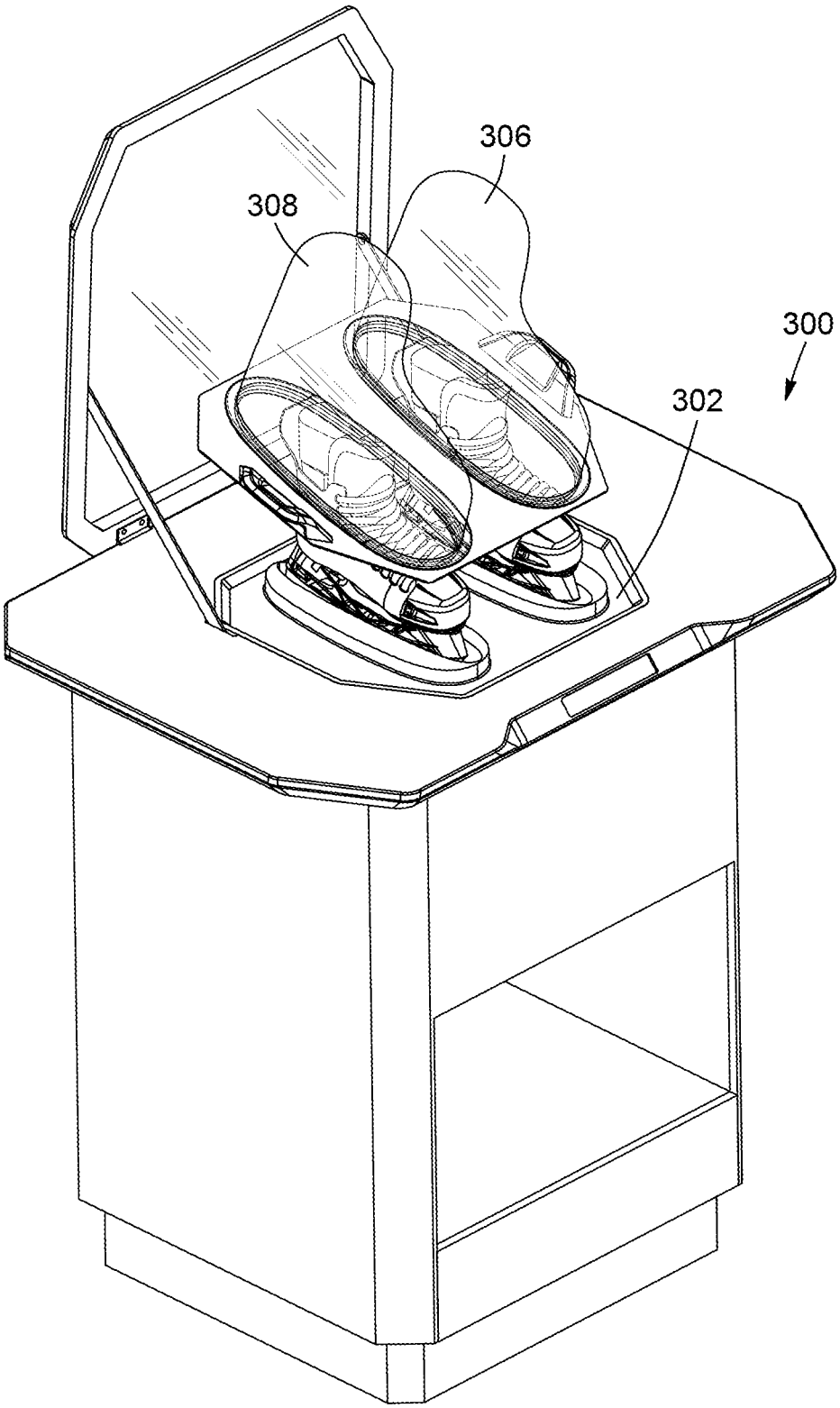
Figure 18:
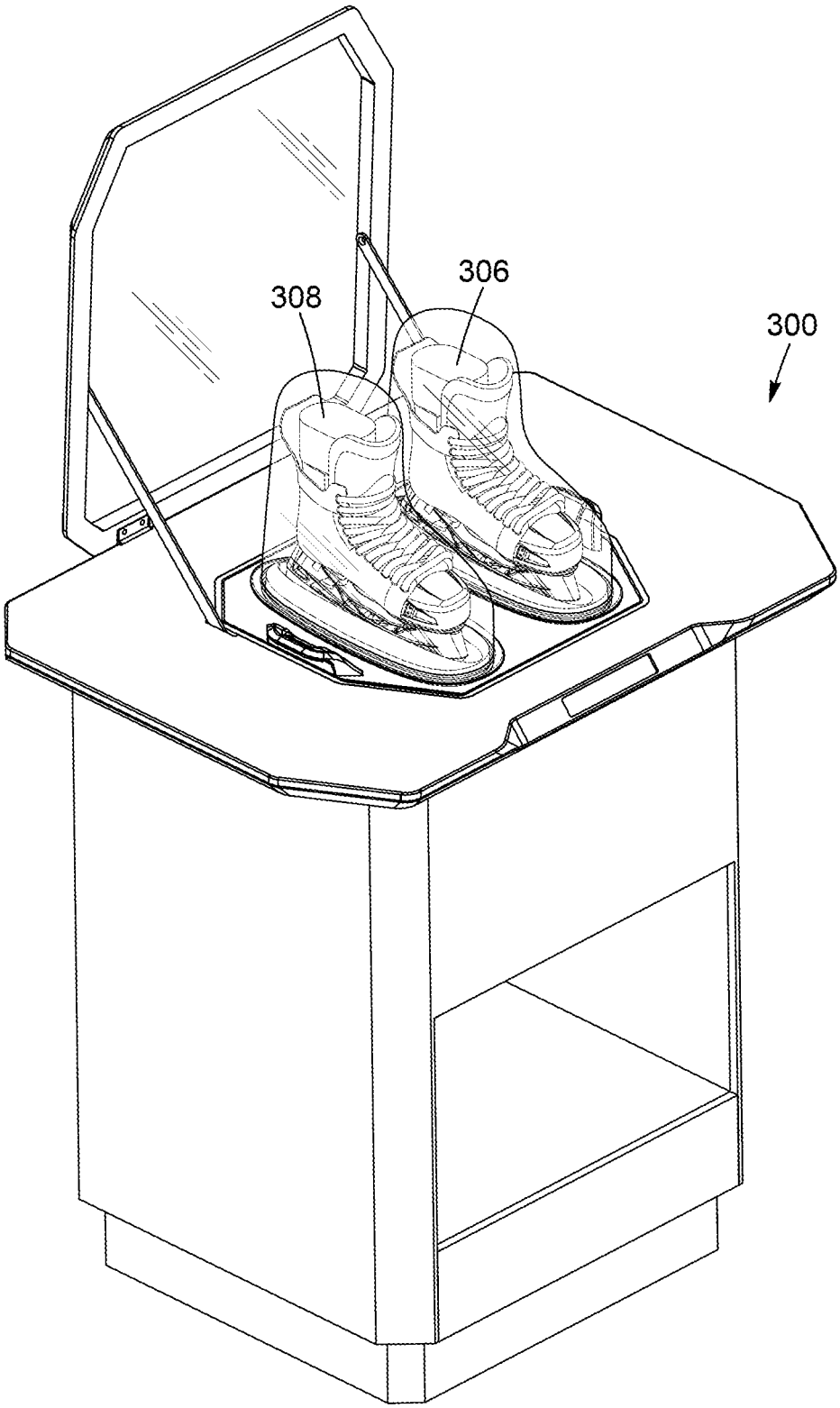
Figure 19:
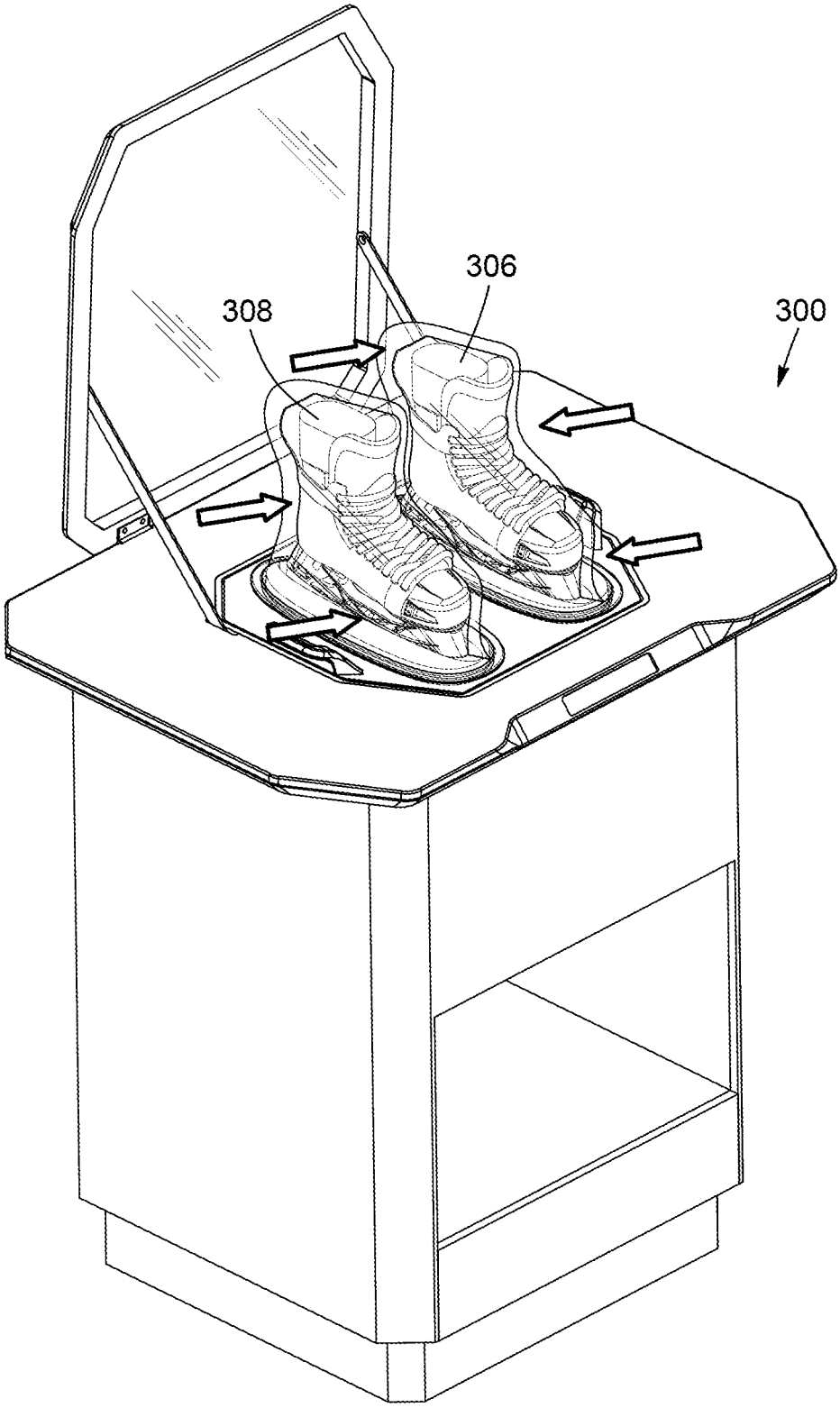

Referring to FIGS. 17 to 19, pressure is applied to each skate boot 10 such the inner surface 16 of the skate boot 10 is thermoformed to follow the respective left 104, 204 and right 106, 206 external surfaces of the left 100, 200 and right 102, 202 inserts and the rear external surface 114, 214 of the rear insert 112, 212. In the variant shown in the drawings, the machine 300 has left and right flexible envelops 306, 308 adapted to cover the left and right skate boots 10. In the shown embodiment, the envelopes 306, 308 are joined at a common base that is shaped to be received by the platform 302 which is slightly recessed within the machine 300, providing a snug fit between the envelops 306, 308 and the machine 300. Fastening or locking means may be provided between the common base of the envelopes 306, 308 and the machine 300. In different embodiments, such coverage of the boots 10 may be partial or full. The operator (or alternatively via other automated means) places the left and right flexible envelops 306, 308 over the left and right skate boots 10. The platform 302 is thus covered by the envelops 306, 308 and an air-tight seal is obtained between the envelops 306, 308 and the platform 302. The operator then operates the machine 300 such that a vacuum is created in each envelop 306, 308 for applying a differential pressure to each skate boot 10. For instance, the machine 300 may include a fan (not shown) to draw air out of the envelops 306, 308, thus creating the vacuum. The applied pressure may be about 5 psi to about 15 psi and may be applied for about 5 minutes to about 10 minutes. Such duration and magnitude of applied pressure may vary. In an alternate embodiment, pressure may be applied to each skate boot 10 while inside the machine 300 through various pressurization means. As such, according to this alternate embodiment, the thermoforming of the boots 10 may be executed without the use of flexible envelops 306, 308.

As discussed above, the top portion TP of the core 118 may ensure that the inserts 100, 102, 200, 202 are well positioned during such pressurization steps. In addition, the top portion TP may prevent the tendon guard 26 from collapsing inwardly during such pressurization steps.

Figure 20:
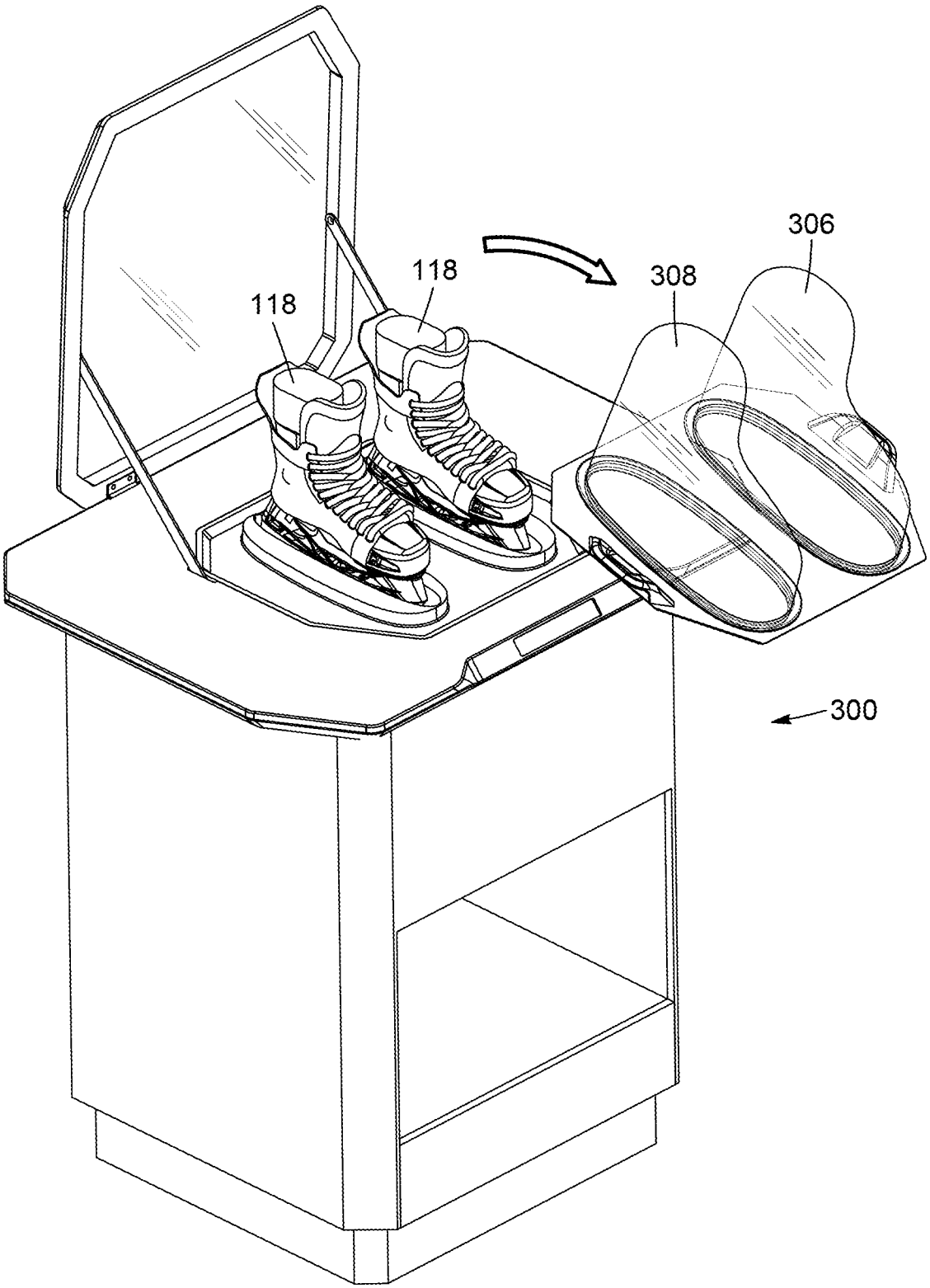

Referring to FIG. 20, once a sufficient duration of time has elapsed and the skate boot(s) 10 have been customized, the flexible envelops 306, 308 are removed. It is understood that the cores 118, the rear inserts 112, 212 and the left 100, 200 and right 102, 202 inserts are afterward removed at the end of the customizing method of the skate boot(s) 10. Such removal may be, for instance, after the boot(s) 10 have been left for a sufficient amount of time to cool. Other removal times may be considered as well.

In various embodiments, the cores 118 may be considered re-usable, as each core 118 can be re-used to customize skate boots 10 for a plurality of clients having similarly-sized feet F. As such, the cores 118 are preferably made from a material that can withstand multiple heating and pressurization cycles without deteriorating. Conversely, the inserts 100, 102, 112, 200, 202, 212 may be considered disposable or sacrificial, as once a client has received their customized boots 10 they likely have no further use for their personalized inserts. In other embodiments, for instance for professional athletes such as hockey players who may go through numerous pairs of skate boots 10 throughout a sports season, the inserts 100, 102, 112, 200, 202, 212 may be kept for a duration of time to customize future pairs of skate boots 10, thus avoiding having to scan their feet F and receive new inserts for each new pair of skate boots 10. As such, the lifespan of the inserts 100, 102, 112, 200, 202, 212 may vary.

Figure 21:
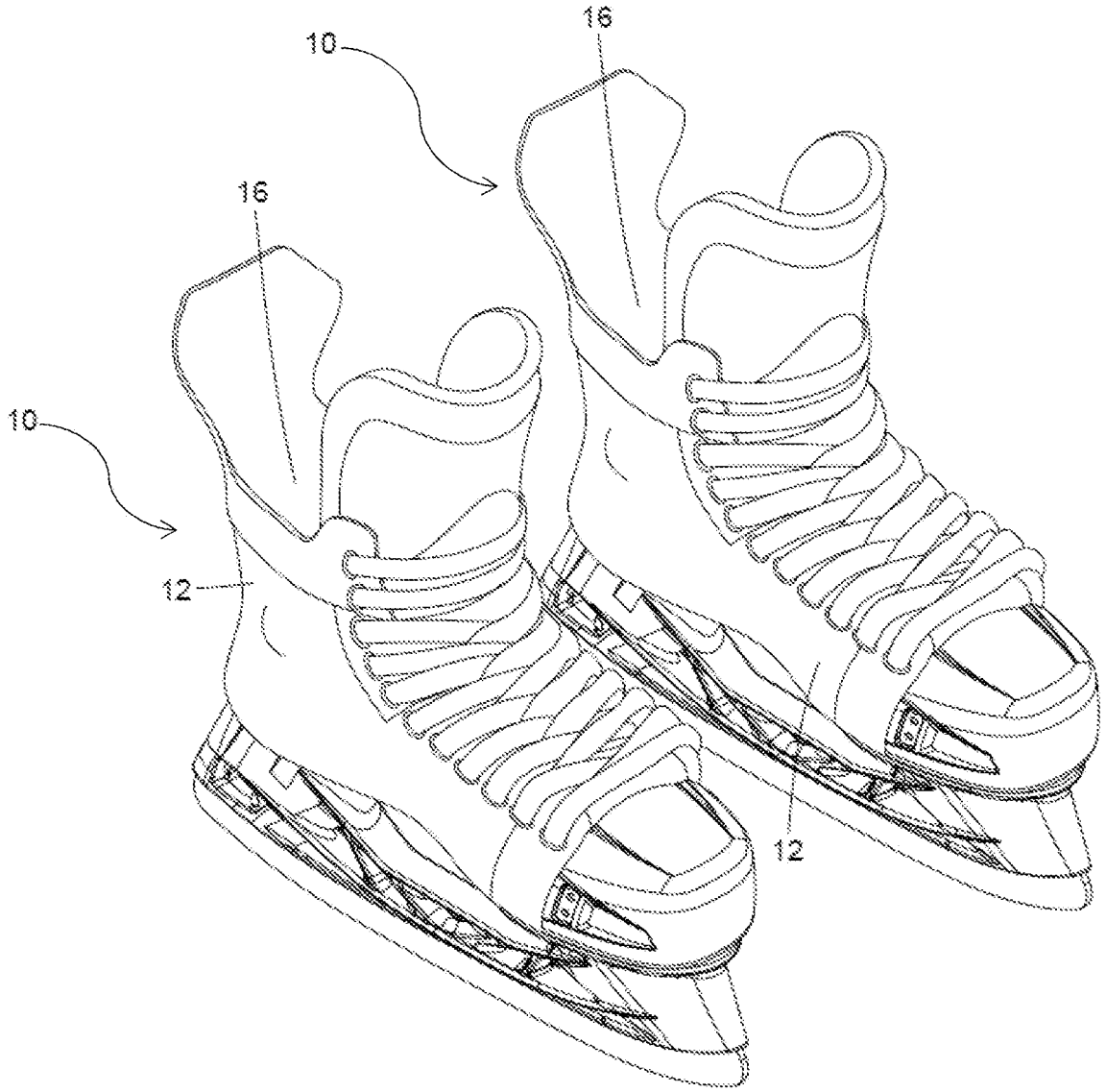
FIG. 21 is a front side perspective view of the skates, each skate having a boot being customized and thermoformed according to the method.

Referring to FIG. 21, each skate boot 10 (in particular each shell 12) is thermoformed such that the inner surface 16 complies with the shape or anatomy of the wearer's foot F in the wearing condition and defines medial, rear and lateral tridimensional shapes complying with the medial, rear and lateral shapes of the wearer's foot F in the wearing condition. For instance, the shell 12 may be thermoformed such that it comprises an ankle portion for complying with the ankle A of the wearer's foot F and medial and lateral side portions for complying with the medial MS and lateral LS sides of the wearer's foot F. The medial and lateral ankle sides of the ankle portion may be thermoformed such that the medial ankle side has a medial cup-shaped depression for receiving the medial malleolus MM and the lateral ankle side has a lateral cup-shaped depression for receiving the lateral malleolus LM. The lateral depression may be located slightly lower than the medial depression for conforming to the anatomy of the wearer's foot F. The heel portion may be thermoformed for complying with the heel H of the wearer's foot F and such that it is substantially cup shaped for following the contour of the heel H. The rear side of the ankle portion may be thermoformed such that it follows the Achilles tendon AT.

The above description of the variants, examples or embodiments should not be interpreted in a limiting manner since other variations, modifications and refinements are possible within the scope of the present disclosure. Accordingly, it should be understood that various features and aspects of the disclosed variants or embodiments can be combined with or substituted for one another in order to form varying modes of the disclosed embodiments. For example, and without limitation, any individual element(s) of the described variants or embodiments may be replaced by alternative elements that provide substantially similar functionality or otherwise provide adequate operation. This includes, for example, presently known alternative elements, such as those that might be currently known to a skilled person in the art, and alternative elements that may be developed in the future, such as those that a skilled person in the art might, upon development, recognize as an alternative. Further, the disclosed variants or embodiments include a plurality of features that are described in concert and that might cooperatively provide a collection of benefits. The present disclosure is not limited to only those embodiments that include all of these features or that provide all of the stated benefits, except to the extent otherwise expressly set forth in the issued claims. Any reference to claim elements in the singular, for example, using the articles "a", "an", or "the", is not to be construed as limiting the element to the singular. Any reference to claim elements as "at least one of X, Y and Z" is meant to include any one of X, Y or Z individually, and any combination of X, Y and Z, including, X, Y, Z; X, Y; X, Z; and Y, Z. The scope of the present disclosure is defined in the appended claims and their equivalents.

What is claimed is:

1. A method of customizing a boot, comprising:

generating a tridimensional digital representation of a wearer's foot using numerical data corresponding to a tridimensional shape of the wearer's foot obtained by scanning the wearer's foot, and processing the numerical data to obtain the tridimensional digital representation of the wearer's foot;

selecting the boot with a foot size corresponding generally to a foot length of the wearer's foot, the boot being at least partially made of a thermoformable material, the boot including an inner surface defining an internal space for receiving the wearer's foot;

selecting a core having a foot size generally corresponding to the foot size of the boot;

obtaining a medical side insert having a medial external surface and a lateral side insert having a lateral external surface, the medial side insert and the lateral side insert manufactured, in absence of the core, based on the tridimensional shape of the foot;

inserting the core, the medial side insert and the lateral side insert into the internal space of the boot such that the medial side insert and the lateral side insert straddle the core, and the medial external surface and the lateral external surface are adjacent the inner surface of the boot;

heating at least a portion of the boot such that the inner surface of the boot is thermoformed to follow the medial external surface and the lateral external surface, the thermoforming defining medial and lateral tridimensional shapes in the inner surface of the boot conforming to the tridimensional shape of the foot; and removing the core, the medial side insert and the lateral side insert from the boot.

2. The method according to claim 1, further comprising obtaining a rear insert having a rear external surface, the rear insert manufactured, in absence of the core, based on a rear portion of the tridimensional shape of the foot, and inserting the rear insert into the internal space of the boot adjacent a rear surface of the core such that the rear external surface is adjacent a rear internal surface of the boot, wherein the rear internal surface of the boot is thermoformable to conform to the rear external surface of the rear insert.

3. The method according to claim 2, wherein the rear insert is inserted into the internal space of the boot before or after inserting the medial side insert and the lateral side insert into the internal space of the boot.

4. The method according to claim 3, wherein the medial side insert, the lateral side insert and the rear insert are inserted into the internal space of the boot before inserting the core into the internal space of the boot.

5. The method according to claim 1, further comprising pre-heating the boot to pre-soften the thermoformable material before inserting the medial side insert and the lateral side insert into the internal space of the boot.

6. The method according to claim 5, wherein pre-heating the boot includes placing the boot in an oven at a temperature of 200° F. to 300° F. for 2 minutes to 5 minutes.

7. The method according to claim 1, wherein heating the boot includes placing the boot in an oven at a temperature of 200° F. to 300° F. for 2 minutes to 4 minutes.

8. The method according to claim 1, wherein heating the boot further includes placing the boot on a platform and enclosing the boot in a flexible envelope such that the boot is covered by the envelope and an air-tight seal is obtained between the envelope and the platform, creating a vacuum in the envelope for applying pressure to the boot.

9. The method according to claim 1, wherein the wearer's foot is scanned in a physical store and the boot is heated in the physical store.

10. The method according to claim 1, wherein heating the boot further includes applying a pressure of 5 psi to 15 psi for 5 minutes to 10 minutes to the boot.

11. The method according to claim 1, further comprising pre-identifying regions of the wearer's foot requiring customization.

12. The method according to claim 11, wherein scanning the wearer's foot further includes scanning only the pre-identified regions of the wearer's foot requiring customization.

13. The method according to claim 1, wherein generating the tridimensional digital representation of the wearer's foot further includes generating the tridimensional digital representation of the wearer's foot in a wearing condition, wherein the medial side insert and the lateral side insert are manufactured based on the tridimensional shape of the foot in the wearing condition, and wherein heating the boot further includes the thermoforming defining medial and lateral tridimensional shapes in the inner surface of the boot conforming to the tridimensional shape of the foot in the wearing condition.

14. A method of customizing a boot, the boot being thermoformable, the method comprising:

providing a re-usable core dimensioned to generally correspond to a foot size of the boot, the re-usable core selected from a group of re-usable cores each corresponding to a different range of standardized foot sizes, a sacrificial medial side insert manufactured based on a tridimensional shape of a wearer's foot, the sacrificial medial side insert having a medial internal surface and a medial external surface generally conforming to a medial side shape of the wearer's foot, and a sacrificial lateral side insert manufactured based on the tridimensional shape of the wearer's foot, the sacrificial lateral side insert having a lateral internal surface and a lateral external surface generally conforming to a lateral side shape of the wearer's foot;

sequentially inserting, into the boot: one or both of the sacrificial medial side insert and the sacrficial lateral side insert; and, subsequently, the re-usable core such that the medial internal surface and the lateral internal surface abut outer surfaces of the re-usable core;

heating at least a portion of the boot such that an inner surface of the boot is thermoformed to follow the medial external surface and the lateral external surface; and removing the core, the sacrificial medial side insert and the sacrificial lateral side insert from the boot.

15. The method according to claim 14, further comprising providing a sacrificial rear insert having a rear external surface, the rear insert is manufactured based on a rear portion of the tridimensional shape of the foot, the method further comprising inserting the sacrificial rear insert into the boot such that the rear external surface is adjacent a rear internal surface of the boot.

16. The method according to claim 14, further comprising pre-heating the boot before inserting the sacrificial medial side insert and the sacrificial lateral side insert into the boot.

17. The method according to claim 16, wherein pre-heating the boot includes placing the boot in an oven at a temperature of 200° F. to 300° F. for 2 minutes to 5 minutes.

18. The method according to claim 14, wherein heating the boot includes placing the boot in an oven at a temperature of 200° F. to 300° F. for 2 minutes to 4 minutes.

19. The method according to claim 14, wherein heating the boot further includes applying a pressure of 5 psi to 15 psi for 5 minutes to 10 minutes to the boot.

20. The method according to claim 14, wherein the sacrificial medial side insert and the sacrificial lateral side are reusable to customize another said boot of the wearer.

* * * * *